US010499713B2

(12) United States Patent
Huang et al.

(10) Patent No.: US 10,499,713 B2
(45) Date of Patent: Dec. 10, 2019

(54) ZIPPER SLIDER LOCK

(71) Applicant: SINOXLOCK (KUNSHAN) CO., LTD, Kunshan, Jiangsu (CN)

(72) Inventors: Yueh-Cheng Huang, New Taipei (TW); Hao-Jhong Lyu, New Taipei (TW); Chia-Wei Weng, New Taipei (TW); Chia-Fang Yu, New Taipei (TW)

(73) Assignee: SINOXLOCK (KUNSHAN) CO., LTD, Kunshan, Jiangsu (CN)

( * ) Notice: Subject to any disclaimer, the term of this patent is extended or adjusted under 35 U.S.C. 154(b) by 0 days.

(21) Appl. No.: 16/134,215

(22) Filed: Sep. 18, 2018

(65) Prior Publication Data

US 2019/0021452 A1 Jan. 24, 2019

Related U.S. Application Data

(62) Division of application No. 16/040,717, filed on Jul. 20, 2018.

(60) Provisional application No. 62/535,055, filed on Jul. 20, 2017.

(51) Int. Cl.

| | |
|---|---|
| ***E05B 37/02*** | (2006.01) |
| ***A44B 19/30*** | (2006.01) |
| ***E05B 65/52*** | (2006.01) |
| ***A44B 19/26*** | (2006.01) |
| ***E05B 35/10*** | (2006.01) |
| ***E05B 37/00*** | (2006.01) |

(52) U.S. Cl.

CPC ..... *A44B 19/30* (2013.01); *A44B 19/262* (2013.01); *A44B 19/301* (2013.01); *E05B 35/105* (2013.01); *E05B 37/0034* (2013.01); *E05B 37/02* (2013.01); *E05B 37/025* (2013.01); *E05B 65/52* (2013.01)

(58) Field of Classification Search

CPC .... E05B 37/02; E05B 37/0034; E05B 37/025; E05B 35/105; E05B 65/52; A44B 19/30; A44B 19/262; A44B 19/301

USPC ..... 70/68, 221, 284, 285

See application file for complete search history.

(56) References Cited

U.S. PATENT DOCUMENTS

| | | | | |
|---|---|---|---|---|
| 2,353,086 | A | 7/1944 | Schaaff | |
| 4,350,375 | A | 9/1982 | Bako | |
| 4,588,218 | A | 5/1986 | Guiler et al. | |
| 5,031,944 | A * | 7/1991 | Keyaki | A44B 19/301 24/387 |
| 6,062,051 | A * | 5/2000 | Nam | A44B 19/301 70/312 |
| 6,189,249 | B1 | 2/2001 | Hughes | |
| 6,308,541 | B1 | 10/2001 | Stowe | |
| 6,981,725 | B2 | 1/2006 | Debrody et al. | |

(Continued)

*Primary Examiner* — Suzanne L Barrett

(74) *Attorney, Agent, or Firm* — Innovation Capital Law Group, LLP; Vic Lin

(57) ABSTRACT

A zipper slider lock is provided. The zipper slider lock includes a first sliding device, a second sliding device, and a lock body. The first sliding device includes a first slider and a first puller, wherein one end of the first puller is connected to the first slider. The second sliding device includes a second slider and a second puller, wherein one end of the second puller is connected to the second slider. The lock body includes a lock hole, wherein the first puller and the second puller can be inserted into the lock body through the lock hole in order to be locked by the lock body.

3 Claims, 27 Drawing Sheets

(56) References Cited

U.S. PATENT DOCUMENTS

| | | | | |
|---|---|---|---|---|
| 7,516,523 | B2 | 4/2009 | Okot | |
| 7,979,964 | B2 * | 7/2011 | Jans | A44B 19/301 24/386 |
| 8,555,683 | B1 * | 10/2013 | Rieder | E05B 65/52 70/21 |
| 8,650,724 | B2 * | 2/2014 | King | A45C 13/103 190/120 |
| 8,661,861 | B2 | 3/2014 | Lai | |
| 9,194,158 | B2 | 11/2015 | Lai | |
| 2005/0109072 | A1 * | 5/2005 | Ling | A44B 19/301 70/68 |
| 2010/0170306 | A1 * | 7/2010 | Fong | A44B 19/301 70/57 |
| 2013/0091906 | A1 | 4/2013 | Chen | |

* cited by examiner

ZIPPER SLIDER LOCK

BACKGROUND OF THE INVENTION

1. Field of the Invention

The present invention generally relates to a zipper slider lock.

2. Description of the Prior Art

Users usually use zipper slider locks to lock the zippers of a case to secure their luggage while traveling. Wherein, the case could be but not limited to a suitcase or a briefcase. Conventionally, a zipper slider lock includes a combination lock or a key lock, and users can unlock the zipper slider lock to open the case by rotating at least one disc to the right combination or using a matching key.

SUMMARY OF THE INVENTION

An object of the present invention is to provide a zipper slider lock which is more convenient to use.

In one embodiment, the zipper slider lock includes a first sliding device, a second sliding device, and a lock body. The first sliding device includes a first slider and a first puller, wherein one end of the first puller is connected to the first slider. The second sliding device includes a second slider and a second puller, wherein one end of the second puller is connected to the second slider. The lock body includes a lock hole, wherein the first puller and the second puller can be inserted into the lock body through the lock hole in order to be locked by the lock body.

In one embodiment, the other end of the first puller has a first puller hole. The other end of the second puller has a second puller hole. One end of the lock body includes a first lock hole and a second lock hole, wherein the openings of the first lock hole and the second lock hole are preferably parallel to each other. When the first slider and the second slider are in the adjacent positions on the X-Y plane, the first puller and the second puller are parallel to the X-Y plane; wherein the first puller at least partially overlaps the second puller; wherein the projections of the first puller hole and the second puller hole on the X-Y plane partially overlap each other. When the first slider and the second slider are in adjacent positions on the X-Y plane, the first puller and the second puller can be inserted into the first lock hole and the second lock hole respectively in order to be locked by the lock body.

In one embodiment, the other end of the first puller has a first puller hole. The other end of the second puller has a second puller hole. One end of the lock body includes a first lock hole and a second lock hole, wherein the openings of the first lock hole and the second lock hole are preferably parallel to each other. When the first slider and the second slider are in adjacent positions on the X-Y plane, the first puller and the second puller are parallel to the X-Z plane. The first puller and the second puller can be inserted into the first lock hole and the second lock hole respectively.

In one embodiment, when the first slider and the second slider are in adjacent positions on the X-Y plane, the first puller and the second puller are perpendicular to the X-Y plane, wherein the first puller and the second puller at least partially cling to each other.

In one embodiment, the first puller and the second puller cling to each other to form a cylinder, wherein the outer surfaces of the first puller and the second puller have a first positioning thread and a second positioning thread respectively. There is a positioning unit inside the lock body. The positioning unit is able to engage with the first positioning thread and the second positioning thread.

In one embodiment, the zipper slider lock includes a first sliding device, a second sliding device, and a fastening unit. The first sliding device includes a first slider lock and a first puller, wherein one end of the first slider lock has a first slider lock hole, wherein the other end of the first slider lock connects to the first puller. The second sliding device includes a second slider lock and a second puller, wherein one end of the second slider lock has a second slider lock hole, wherein the other end of the second slider lock connects to the second puller. The fastening unit includes a first fastening part and a second fastening part disposed at opposite ends of the fastening unit. When the first slider lock and the second slider lock are in adjacent positions, the first slider lock, the fastening unit, and the second slider lock cling to each other, wherein the fastening unit is between the first slider lock and the second slider lock. The first fastening part and the second fastening part are inserted into the first slider lock hole and the second slider lock hole respectively and can be locked by the first slider lock and the second slider lock respectively.

In one embodiment, the zipper slider lock includes a first sliding device and a second sliding device. The first sliding device includes a first slider lock and a first puller, wherein one end of the first puller is connected to one end of the first slider lock close to the second sliding device. The second sliding device includes a second slider lock and a second puller, wherein one end of the second puller is connected to one end of the second slider lock close to the first sliding device. When the first slider lock and the second slider lock are in adjacent positions, the first slider lock and the second slider lock cling to each other and can be locked. The first puller and the second puller are able to cling to the surfaces of the first slider lock and the second slider lock.

In one embodiment, the zipper slider lock includes a first sliding device and a second sliding device. The first sliding device includes a first slider lock and a first puller, wherein one end of the first puller is connected to one end of the first slider lock. The second sliding device includes a second slider lock and a second puller, wherein one end of the second puller is connected to one end of the second slider lock. When the first slider lock and the second slider lock are in adjacent positions, the first slider lock and the second slider lock cling to each other and can be locked.

In one embodiment, a first pin part is disposed on an end face of the first slider lock, wherein a second lock hole corresponding to the first pin part is disposed on an end face of the second slider lock. When the first slider lock and the second slider lock cling to each other, the first pin part can be inserted into the second lock hole and can be locked by the second slider lock.

In one embodiment, the zipper slider lock includes a first sliding device, a second sliding device, and a fastening unit. The first sliding device includes a first slider and a first puller lock, wherein one end of the first puller lock is connected to one end of the first slider. The second sliding device includes a second slider and a second puller lock, wherein one end of the second puller lock is connected to one end of the second slider. When the first slider and the second slider are in adjacent positions, the first puller lock and the second puller lock cling to each other, wherein the opposite ends of the fastening unit are inserted into and are locked by the first puller lock and the second puller lock respectively.

In one embodiment, the zipper slider lock is used with a first sliding device and a second sliding device. The first sliding device includes a first slider and a first puller. The second sliding device includes a second slider and a second puller. The first slider includes a first fixing ring, wherein the first puller is connected to the first fixing ring. The second slider includes a second fixing ring, wherein the second puller is connected to the second fixing ring. The zipper slider lock includes a lock device and a cable. The lock device includes a first lock, a second lock, and a fastening unit. The first lock includes a first A lock hole and a first B lock hole. The second lock includes a second A lock hole and a second B lock hole. The fastening unit includes a first fastening part and a second fastening part disposed at opposite ends of the fastening unit. The first lock, the second lock, and the fastening unit are able to cling to each other to make the first fastening part and the second fastening part inserted into the first A lock hole and the second A lock hole and be locked by the first lock and the second lock respectively. When the first slider and the second slider are in adjacent positions, one end of the cable can be inserted into the first B lock hole and be locked by the first lock, wherein the other end of the cable passes through the first fixing ring and the second fixing ring and enters into the second B lock hole and is locked by the second lock.

In one embodiment, the zipper slider lock includes a lock body, a button, and a bolt. The lock body included a first end face, a second end face, and a cylinder surface. One end of the lock body close to the first end face invaginates from the cylinder surface to form a first recess. The button is disposed on the second end face and can be pressed into the lock body by an external force. The bolt is disposed in the lock body and moves together with the button. When the button is pressed into the lock body by the external force, the bolt extends out of the lock body and toward the first recess to close the first recess.

In one embodiment, the zipper slider lock includes a lock device and a rod. The lock device includes a first lock and a second lock. The opposite ends of the rod can be inserted into and be locked by the first lock and the second lock respectively.

In one embodiment, the zipper slider lock includes a first sliding device, a second sliding device and a lock body. The first sliding device includes a first slider and a first puller, wherein one end of the first puller is connected to the first slider. The second sliding device includes a second slider and a second puller, wherein one end of the second puller is connected to the second slider. When the first slider and the second slider are in adjacent positions, one side of the first puller and one side of the second puller cling to each other. One end of the lock body includes a first lock hole. When the first slider and the second slider are in adjacent positions, the first puller and the second puller can be inserted into the first lock hole respectively in order to be locked by the lock body.

BRIEF DESCRIPTION OF THE DRAWINGS

FIGS. 1H-1I are schematic views of another embodiment of the present invention.

DETAILED DESCRIPTION OF THE PREFERRED EMBODIMENT

Figure 1A:
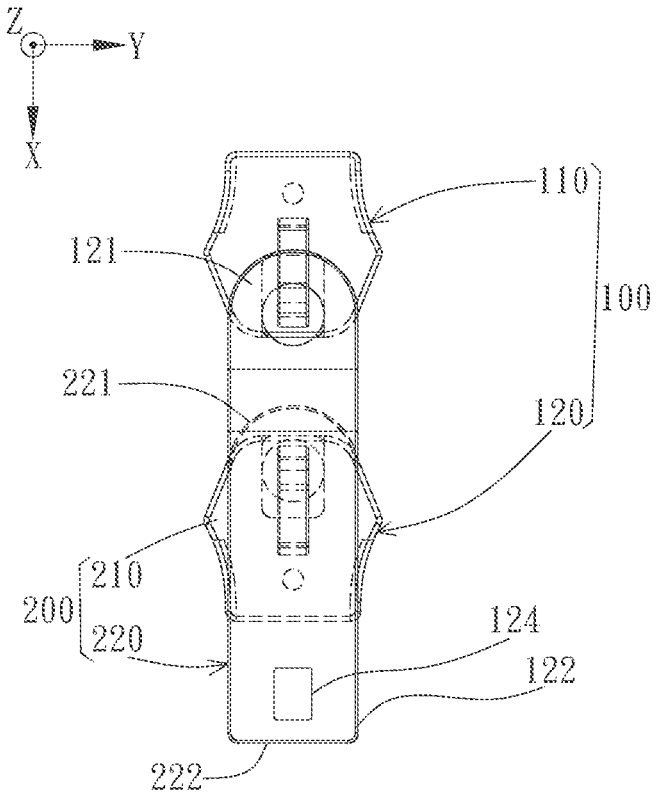
FIGS. 1A-1G are schematic views of an embodiment of the present invention.
Figure 1B:
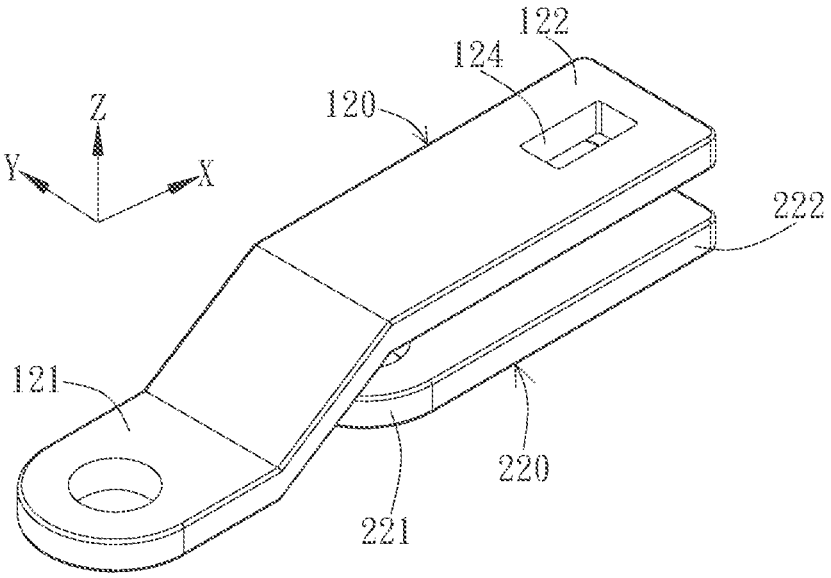
Figure 1C:
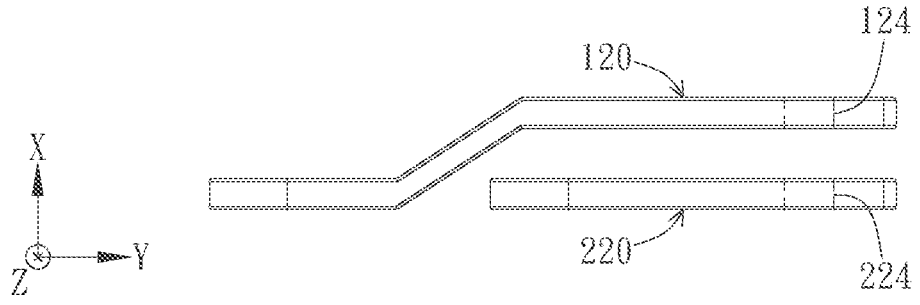

As shown in the embodiment in FIG. 1A, the zipper slider lock of the present invention includes a first sliding device 100, a second sliding device 200, and a lock body 300. The first sliding device 100 includes a first slider 110 and a first puller 120, wherein one end 121 of the first puller 120 is connected to the first slider 110, wherein the other end 122 of the first puller 120 has a first puller hole 124. The second sliding device 200 includes a second slider 210 and a second puller 220, wherein one end 221 of the second puller 220 is connected to the second slider 210, wherein the other end 222 of the second puller 220 has a second puller hole. As shown in FIGS. 1A-1C, when the first slider 110 and the second slider 210 are in adjacent positions on the X-Y plane, the first puller 120 and the second puller 220 are parallel to the X-Y plane. The first puller 120 at least partially overlaps the second puller 220. The projections of the first puller hole 124 and the second puller hole 224 on the X-Y plane partially overlap each other.

Figure 1D:
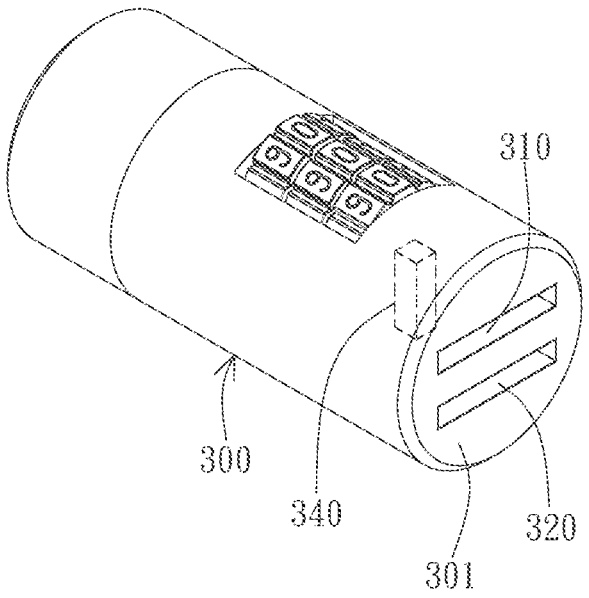
Figure 1E:
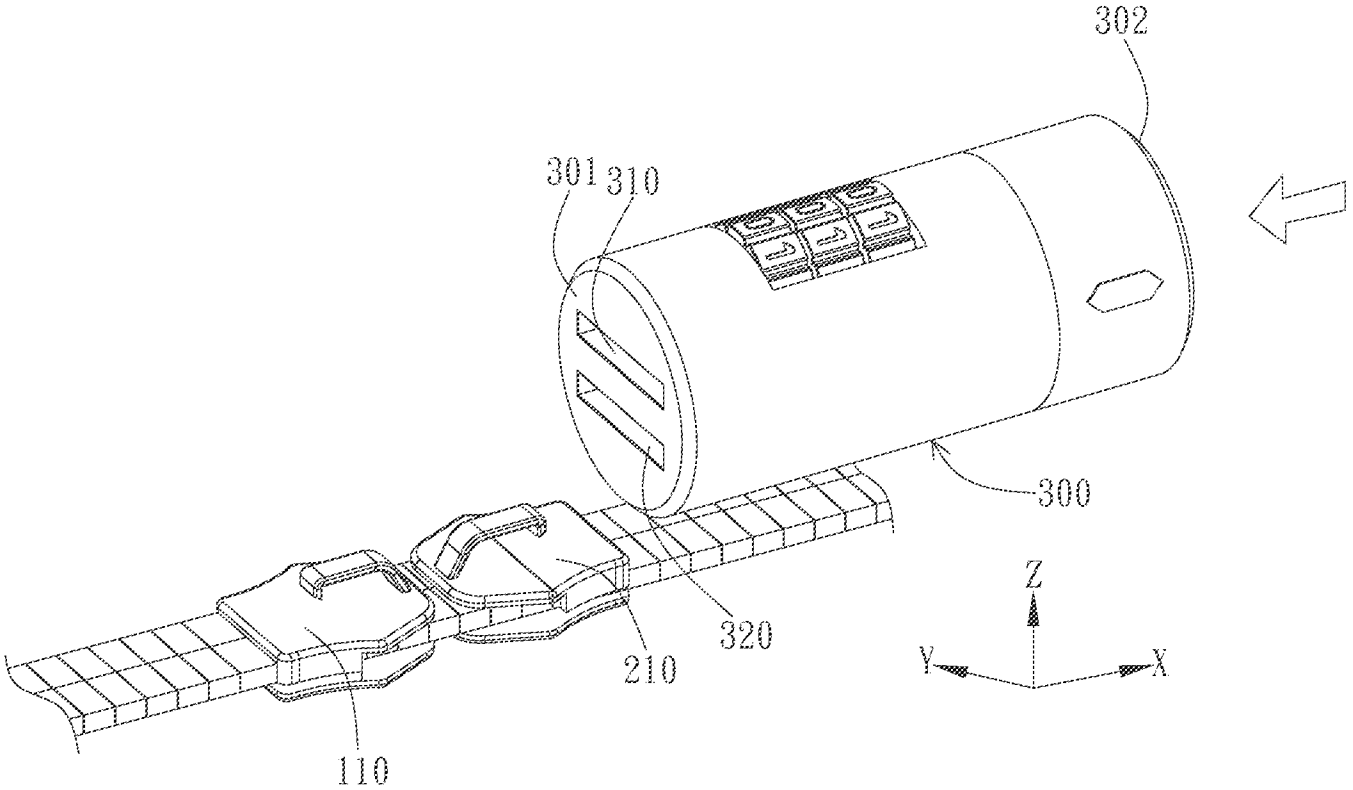
Figure 1F:
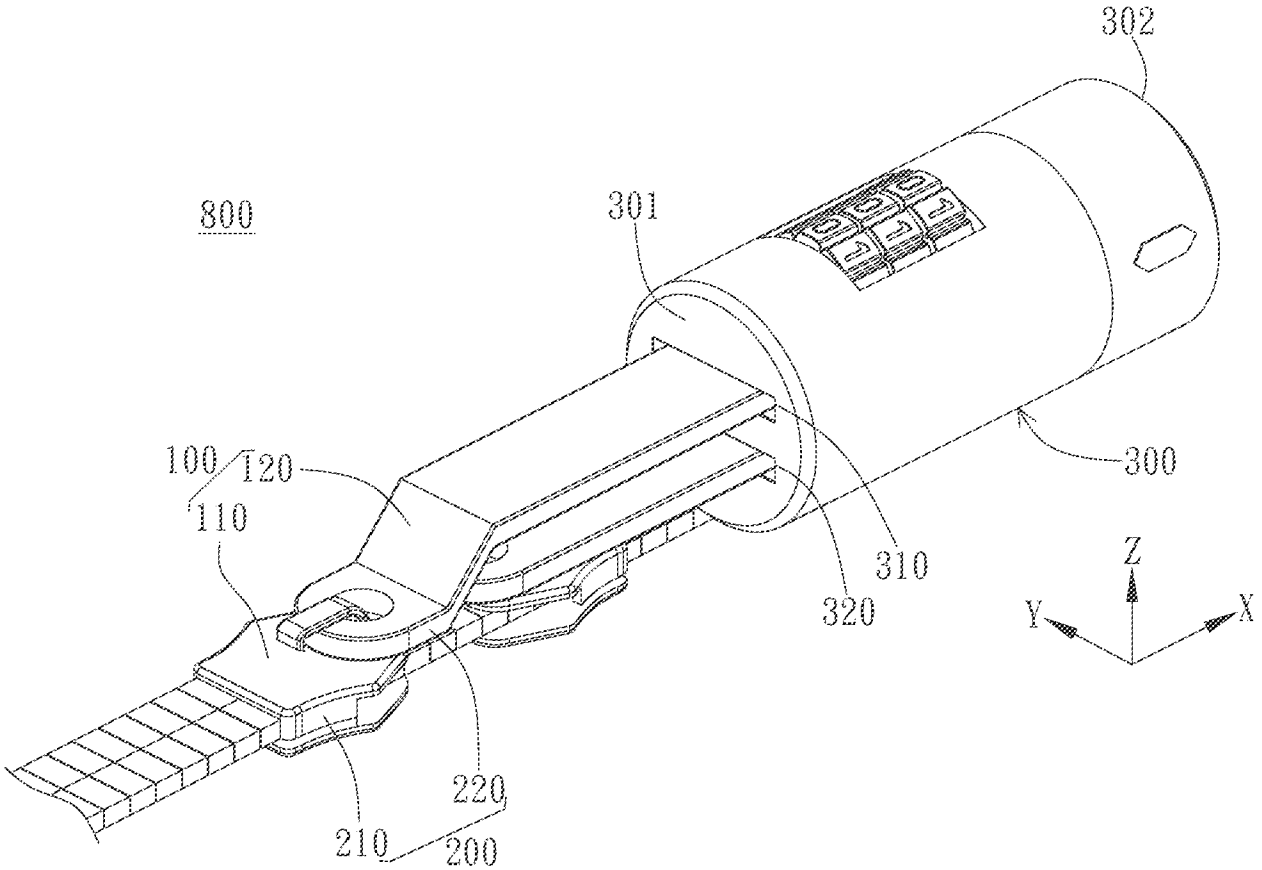
Figure 1G:
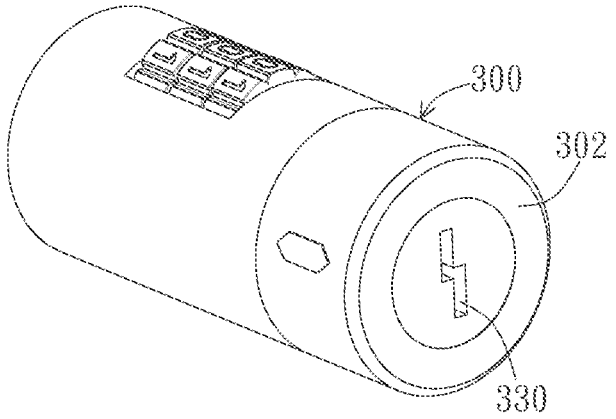

As shown in FIGS. 1D and 1E, one end 301 of the lock body 300 includes a first lock hole 310 and a second lock hole 320. The openings of the first lock hole 310 and the second lock hole 320 are preferably parallel to each other. As shown in FIG. 1F, when the first slider 110 and the second slider 210 are in adjacent positions on the X-Y plane, the first puller 120 and the second puller 220 can be inserted into the first lock hole 310 and the second lock hole 320 respectively in order to be locked by the lock body 300. More particularly, there is a positioning pin 340 inside the lock body 300. When the first puller 120 and the second puller 220 are inserted into the first lock hole 310 and the second lock hole 320 respectively, the positioning pin goes through the first puller hole 124 and the second puller hole 224. While locked, the lock body restricts the positioning pin from leaving the first puller hole 124 and the second puller hole 224, hence restricts the first puller 120 and the second puller 220 from leaving the first lock hole 310 and the second lock hole 320, and therefore restricts the first sliding device 100 and the second sliding device 200 form leaving each other. While unlocked, the restriction of the lock body 300 on the positioning pin to prevent it from leaving the first puller hole 124 and the second puller hole 224 is removed, hence the positioning pin is able to leave the first puller hole 124 and the second puller hole 224. Therefore, the first puller 120 and the second puller 220 are able to leave the first lock hole 310 and the second lock hole 320 respectively, hence the first sliding device 100 and the second sliding device 200 are able to leave each other. As a preferable embodiment shown in FIG. 1G, the other end 302 of the lock body 300 includes a third lock hole 330. The authorities such as the customs can insert keys provided by the manufacturer of the lock into the third lock hole 330 to unlock the lock.

Figure 1H:
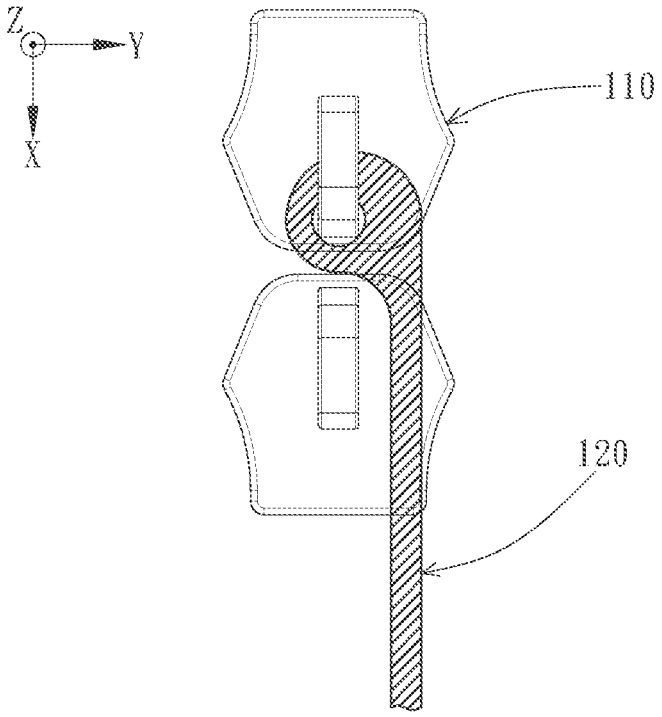
Figure 11:
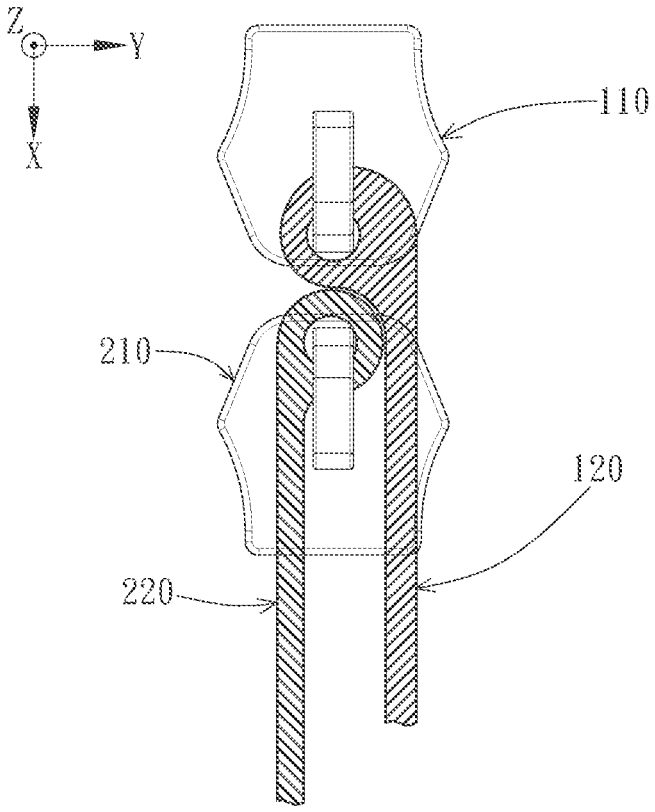
FIGS. 11A-11G are schematic views of another embodiment of the present invention.

In different embodiments, when the first slider 110 and the second slider 210 are adjacent to each other, the first puller 120 and the second puller 220 are not limited to being parallel to the X-Y plane. More particularly, as shown in the embodiments in FIGS. 1H and 11, when the first slider 110 and the second slider 210 are in adjacent positions on the X-Y plane, the first puller 120 and the second puller 220 are parallel to the X-Z plane. At this time, the first puller 120 and the second puller 220 can be inserted into the first lock hole 310 and the second lock hole 320 respectively by adjusting merely the directions of the openings of the first lock hole and the second lock hole, e.g. rotating the lock body or changing the opening directions of the lock holes.

Figure 2A:
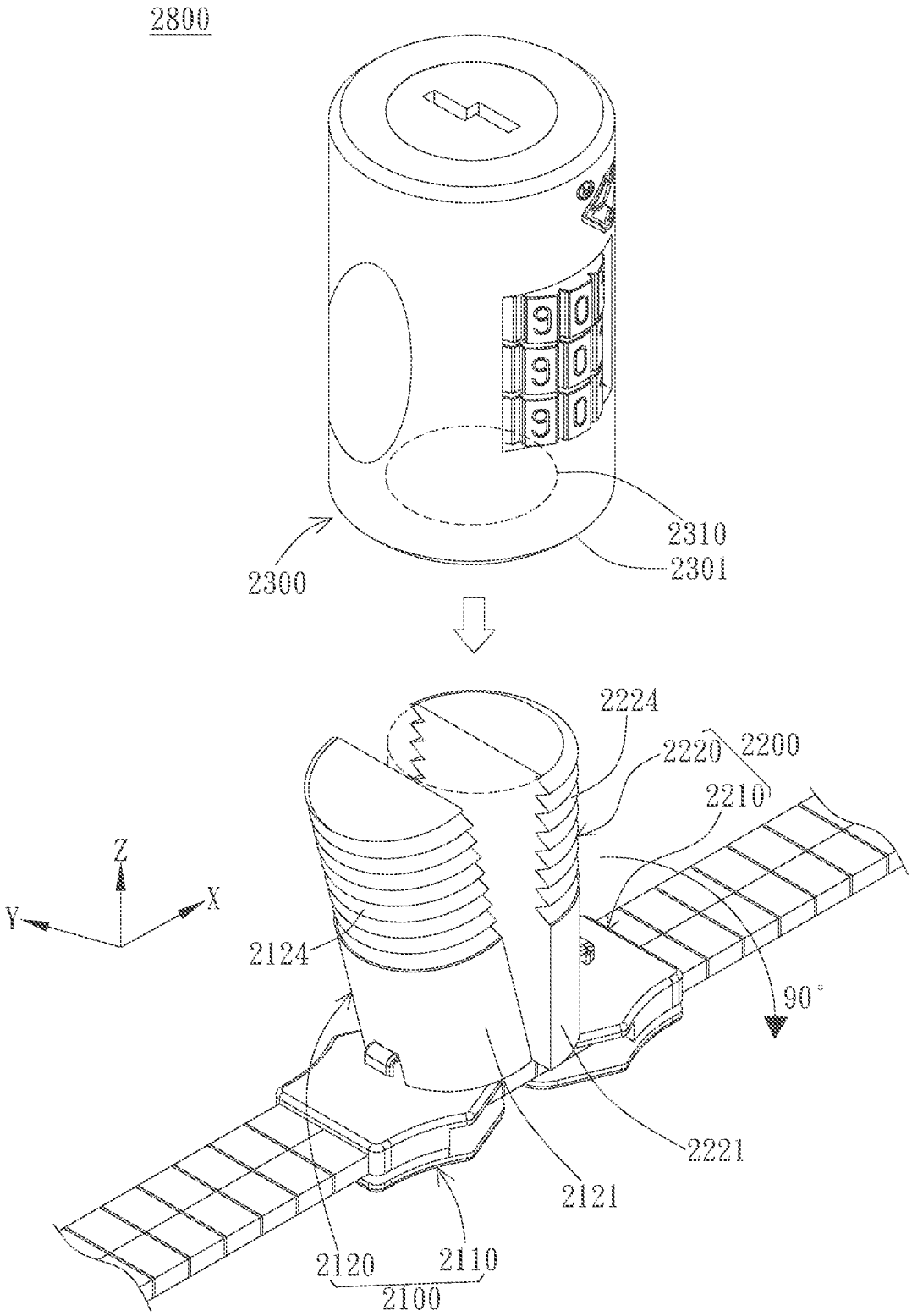
FIGS. 2A-2C are schematic views of another embodiment of the present invention.
Figure 2B:
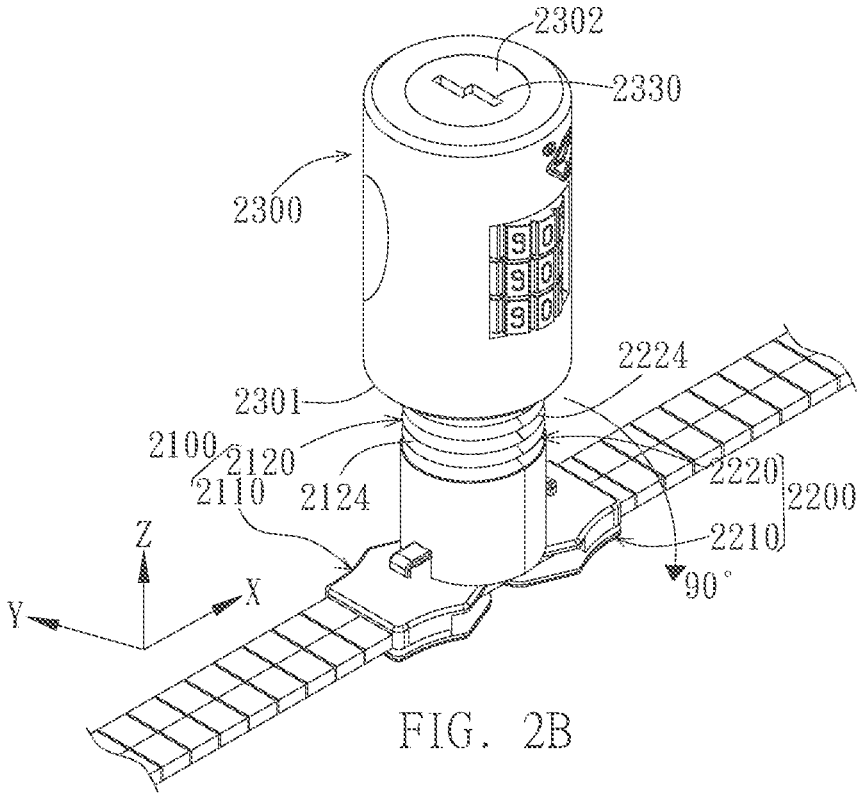
Figure 2C:
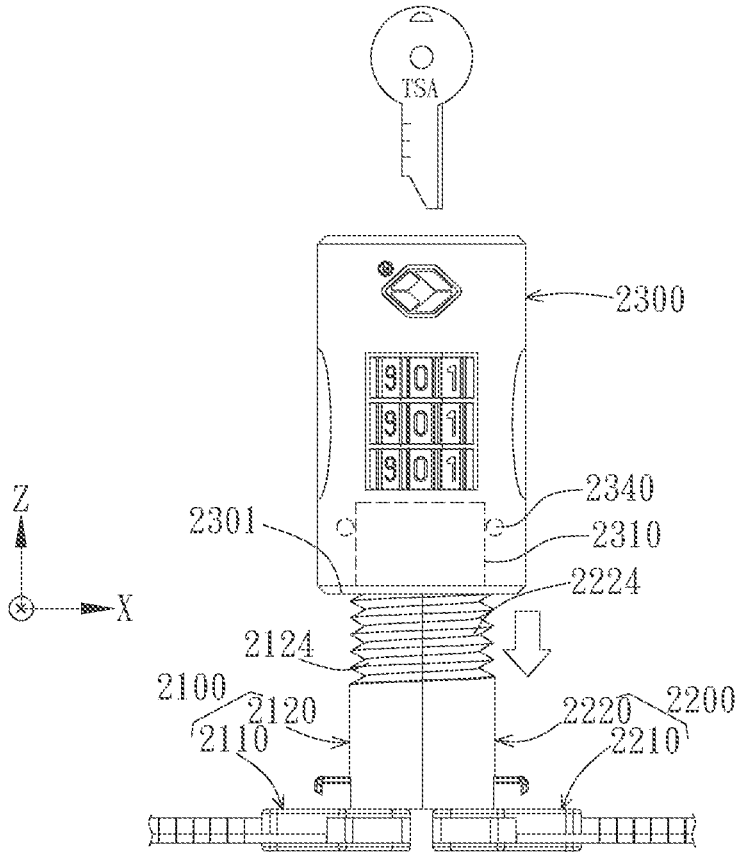

As shown in the embodiments in FIGS. 2A-2C, the zipper slider lock 2800 of the present invention includes a first sliding device 2100, a second sliding device 2200, and a lock body 2300. The first sliding device 2100 includes a first slider 2110 and a first puller 2120, wherein one end 2121 of the first puller 2120 is connected to the first slider 2110. The second sliding device 2200 includes a second slider 2210 and a second puller 2220, wherein one end 2221 of the second puller 2220 is connected to the second slider 2210. As shown in FIGS. 2B and 2C, when the first slider 2110 and the second slider 2210 are in adjacent positions on the X-Y plane, the first puller 2120 and the second puller 2220 are perpendicular to the X-Y plane, wherein the first puller 2120 and the second puller 2220 at least partially cling to each other.

One end 2301 of the lock body 2300 includes a first lock hole 2310. As shown in the embodiments in FIGS. 2B and 2C, when the first slider 2110 and the second slider 2210 are in adjacent positions on the X-Y plane, the end 2301 of the lock body 2300 could face the first puller 2120 and the second puller 2220, wherein the first puller 2120 and the second puller 2220 can be inserted into the first lock hole 2310 together to be locked by the lock body 2300. In a preferable embodiment, the first puller 2120 and the second puller 2220 cling to each other to form a cylinder. The outer surfaces of the first puller 2120 and the second puller 2220 have respectively a first positioning thread 2124 and a second positioning thread 2224. There is a positioning unit 2340 inside the lock body 2300. The positioning unit 2340 is preferably a clamp. While locked, the positioning unit 2340 engages with the first positioning thread 2124 and the second positioning thread 2224, hence restricting the first puller 2120 and the second puller 2220 from leaving the first lock hole 2310, and therefore restricting the first sliding device 2100 and the second sliding device 2200 form leaving each other. While unlocked, the engagement of the positioning unit 2340 with the first puller 2120 and the second puller 2220 is removed. Therefore, the first puller 2120 and the second puller 2220 are able to leave the first lock hole 2310, and hence the first sliding device 2100 and the second sliding device 2200 are able to leave each other. As shown in a preferable embodiment in FIG. 2B, the other end 2302 of the lock body 2300 includes a third lock hole 2330. The authorities such as the customs can insert keys provided by the manufacturer of the lock into the third lock hole 2330 to unlock the lock.

Figure 3A:
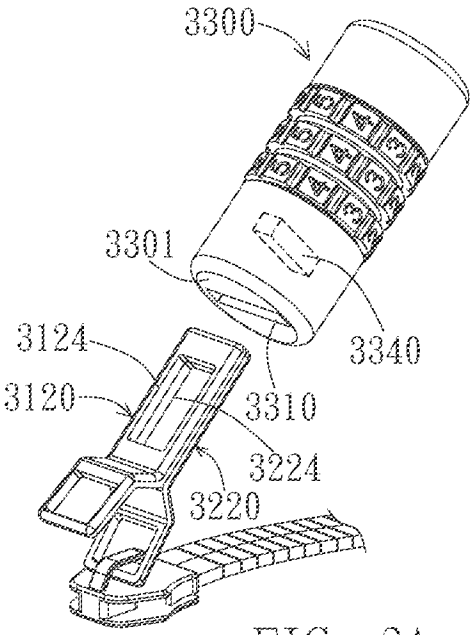
FIGS. 3A-3C are schematic views of another embodiment of the present invention.
Figure 3B:
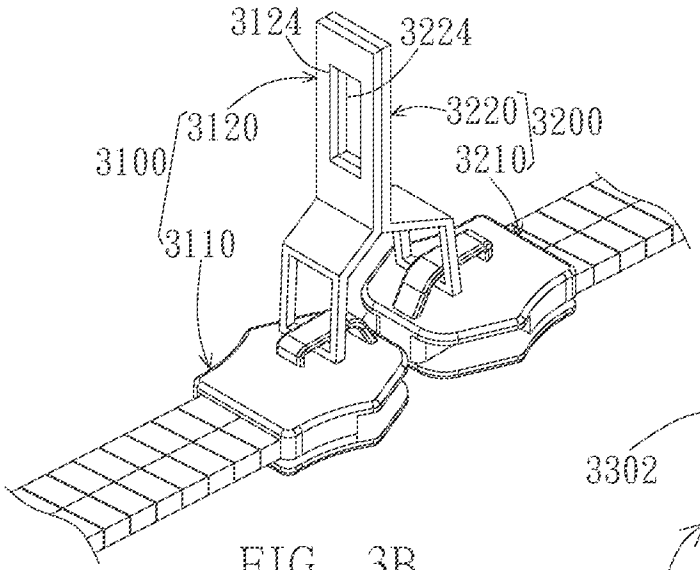
Figure 3C:
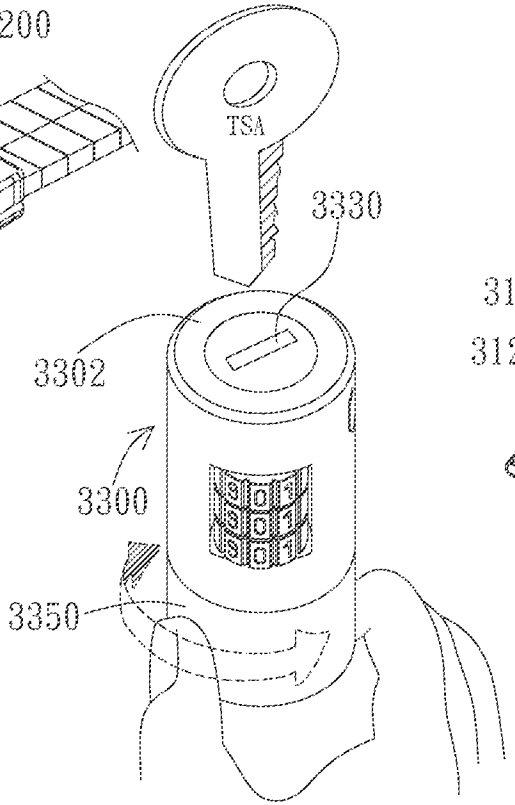
Figure 4A:
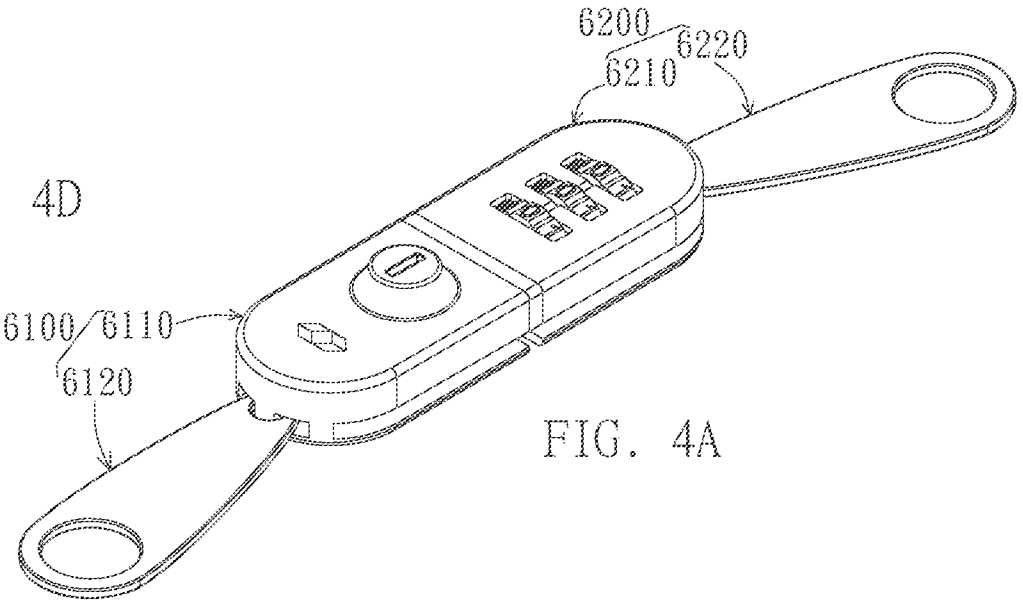
FIGS. 4A-4E are schematic views of another embodiment of the present invention.
Figure 4B:
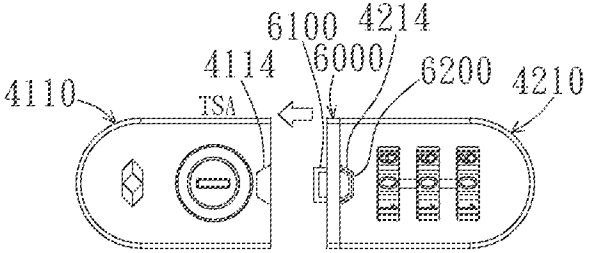
Figure 4C:
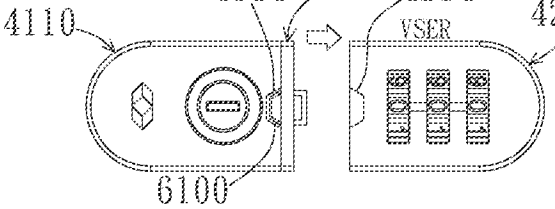
Figure 4D:
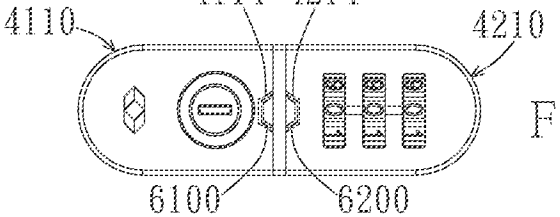
Figure 4E:
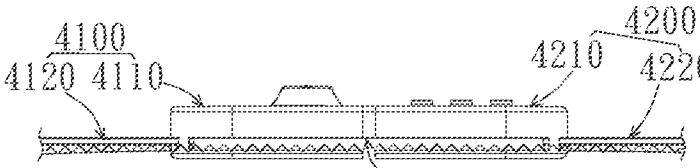

In different embodiments, the first puller and the second puller are not limited to clinging to each other to form a cylinder. As shown in the embodiment in FIGS. 3A and 3B, the first puller 3120 and the second puller 3220 have a first puller hole 3124 and a second puller hole 3224 respectively. There is a positioning pin 3340 inside the lock body 3300. When the first puller 3120 and the second puller 3220 are inserted into a first lock hole 3310 of one end 3301 of the lock body 3300, the positioning pin 3340 goes into the first puller hole 3124 and the second puller hole 3224. While locked, the lock body 3300 restricts the positioning pin 3340 from leaving the first puller hole 3124 and the second puller hole 3224, hence restricts the first puller 3120 and the second puller 3220 from leaving the first lock hole 3310, and therefore restricts the first sliding device 3100 and the second sliding device 3200 form leaving each other. While unlocked, the restriction of the lock body 3300 on the positioning pin 3340 to prevent it from leaving the first puller hole 3124 and the second puller hole 3224 is removed, hence the positioning pin 3340 is able to leave the first puller hole 3124 and the second puller hole 3224. Therefore, the first puller 3120 and the second puller 3220 are able to leave the first lock hole 3310, hence the first sliding device 3100 and the second sliding device 3200 are able to leave each other. As shown in a preferable embodiment in FIG. 3C, the other end 3302 of the lock body 3300 includes a third lock hole 3330. The authorities such as the customs can insert keys provided by the manufacturer of the lock into the third lock hole 3330 to unlock the lock. On the other hand, the lock body 3300 further includes a rotating device 3350 close to the other end 3302 for locking and unlocking the lock body 3300 by rotating.

As shown in the embodiments in FIGS. 4A-4E, the zipper slider lock of the present invention includes a first sliding device 4100, a second sliding device 4200, and a fastening unit 6000. As shown in FIGS. 4A-4E, the first sliding device 4100 includes a first slider lock 4110 and a first puller 4120. One end of the first slider lock 4110 has a first slider lock hole 4114, wherein the other end of the first slider lock 4110 connects to the first puller 4120. The second sliding device 4200 includes a second slider lock 4210 and a second puller 4220. One end of the second slider lock 4210 has a second slider lock hole 4214, wherein the other end of the second slider lock 4210 connects to the second puller 4220. The fastening unit 6000 includes a first fastening part 6110 and a second fastening part 6200 disposed at opposite ends of the fastening unit 6000. When the first slider lock 4110 and the second slider lock 4210 are in adjacent positions, the first slider lock 4110, the fastening unit 6000, and the second slider lock 4210 cling to each other, wherein the fastening unit 6000 is between the first slider lock 4110 and the second slider lock 4210. The first fastening part 6110 and the second fastening part 6200 are inserted into the first slider lock hole 4114 and the second slider lock hole 4214 respectively and can be locked by the first slider lock 4110 and the second slider lock 4210 respectively.

More particularly, there are positioning pins inside the first slider lock 4110 and the second slider lock 4210 respectively. When the first fastening part 6100 and the second fastening part 6200 are inserted into the first slider lock hole 4114 and the second slider lock hole 4214 respectively, the positioning pins go into the first fastening part 6100 and the second fastening part 6200 respectively. While locked, the first slider lock 4110 and the second slider lock 4210 restrict the positioning pins from leaving the first fastening part 6100 and the second fastening part 6200 respectively, hence restricts the first fastening part 6100 and the second fastening part 6200 from leaving the first slider lock hole 4114 and the second slider lock hole 4214, and therefore restricts the first slider lock 4110, the fastening unit 6000, and the second slider lock 4210 form leaving each other. While unlocked, the restriction of the first slider lock 4110 and the second slider lock 4210 on the positioning pins to prevent it from leaving the first fastening part 6100 and the second fastening part 6200 respectively is removed, hence the positioning pins are able to leave the first fastening part 6100 and the second fastening part 6200. Therefore, the first fastening part 6100 and the second fastening part 6200 are able to leave the first slider lock hole 4114 and the second slider lock hole 4214 respectively, hence the first slider lock 4110, the fastening unit 6000, and the second slider lock 4210 are able to leave each other. In a preferable embodiment, the first slider lock 4110 includes a customs lock core and a third lock hole 4330. The authorities such as the customs can insert keys provided by the manufacturer of the lock into the third lock hole 4330 to unlock the lock.

Figure 5A:
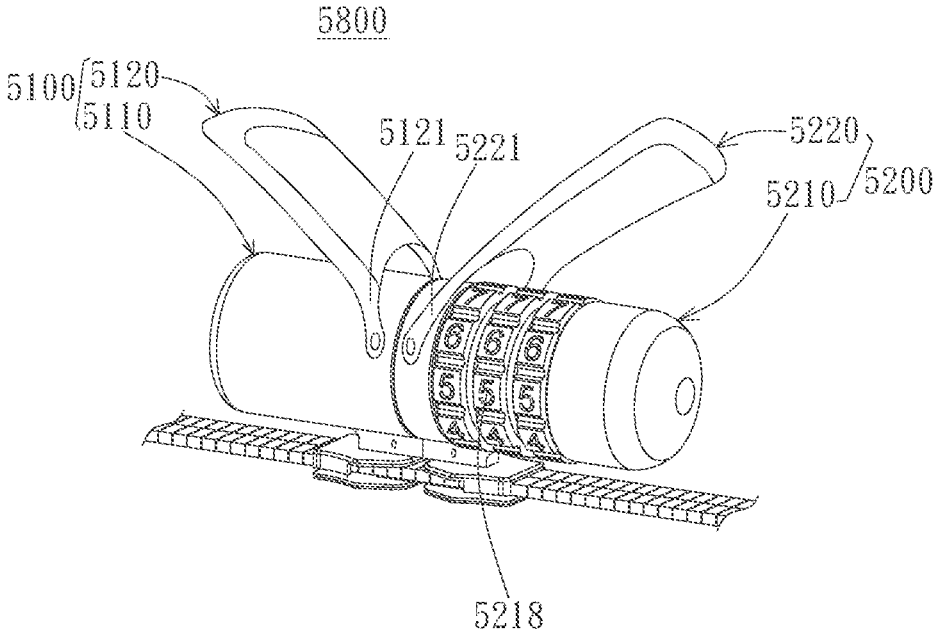
FIGS. 5A-5B are schematic views of another embodiment of the present invention.
Figure 5B:
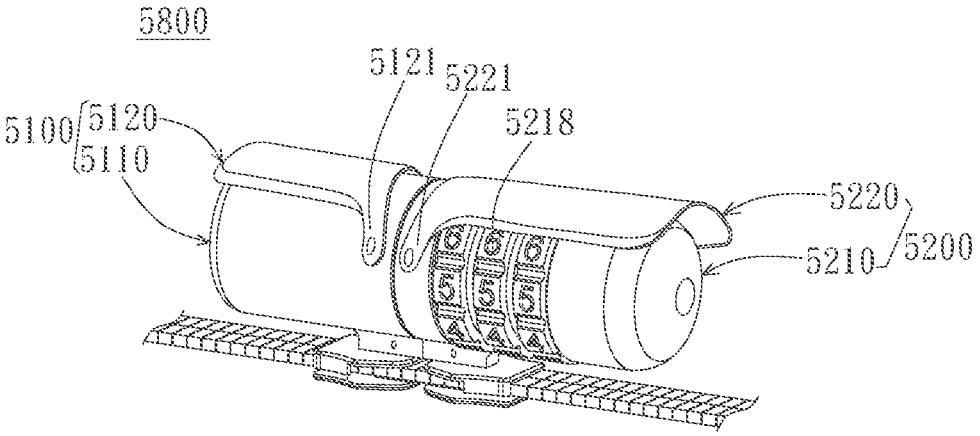

As shown in the embodiments in FIGS. 5A and 5B, the zipper slider lock 5800 of the present invention includes a first sliding device 5100 and a second sliding device 5200. The first sliding device 5100 includes a first slider lock 5110 and a first puller 5120, wherein one end 5121 of the first puller 5120 is connected to one end of the first slider lock 5110 close to the second sliding device 5200. The second sliding device 5200 includes a second slider lock 5210 and a second puller 5220, wherein one end 5221 of the second puller 5220 is connected to one end of the second slider lock 5210 close to the first sliding device 5100. When the first slider lock 5110 and the second slider lock 5210 are in adjacent positions, the first slider lock 5110 and the second slider lock 5210 cling to each other and can be locked. As shown in FIG. 5B, the first puller 5210 and the second puller 5220 are able to cling to the surfaces of the first slider lock 5110 and the second slider lock 5210.

More particularly, since the first puller 5210 and the second puller 5220 are able to cling to the surfaces of the first slider lock 5110 and the second slider lock 5210, the volume of the first sliding device 5100 and the second sliding device 5200 is reduced, and the appearance is more minimal and graceful. One the other hand, as shown in the embodiments in FIGS. 5A and 5B, the second slider lock 5210 is a combination lock. The second puller 5220 is able to cover at least a portion of the number discs when clinging to the surface of the second slider lock 5210 and hence protects the number discs. In a preferable embodiment, the first slider lock 5110 includes a customs lock core and a third lock hole disposed in the other end of the first slider lock 5110 with respect to the second slider lock 5210. The authorities such as the customs can insert keys provided by the manufacturer of the lock into the third lock hole to unlock the lock. In different embodiments, one end 5121 of the first puller 5120 is connected to one end of the first slider lock 5110 away from the second sliding device 5200. One end 5221 of the second puller 5220 is connected to one end of the second slider lock 5210 away from the first sliding device 5100.

Figure 6A:
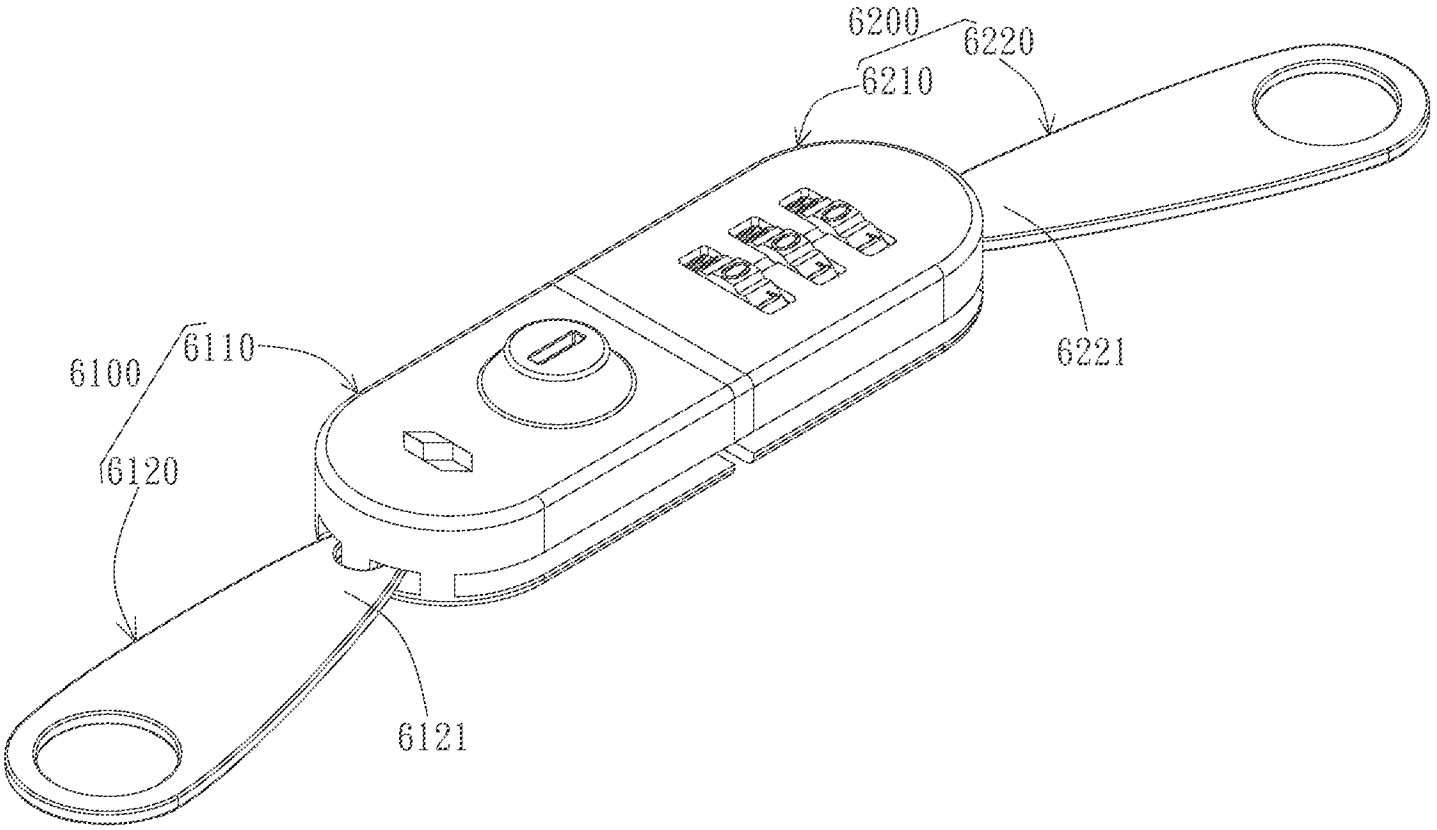
FIGS. 6A-6E are schematic views of another embodiment of the present invention.
Figure 6B:
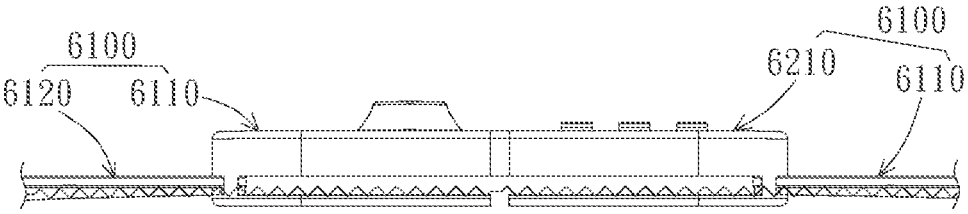
Figure 6C:
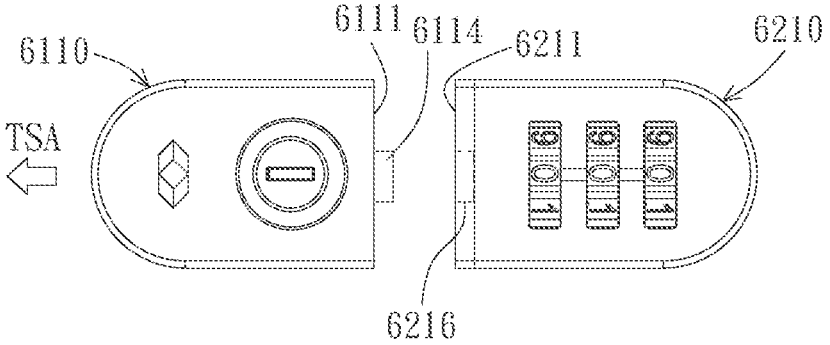
Figure 6D:
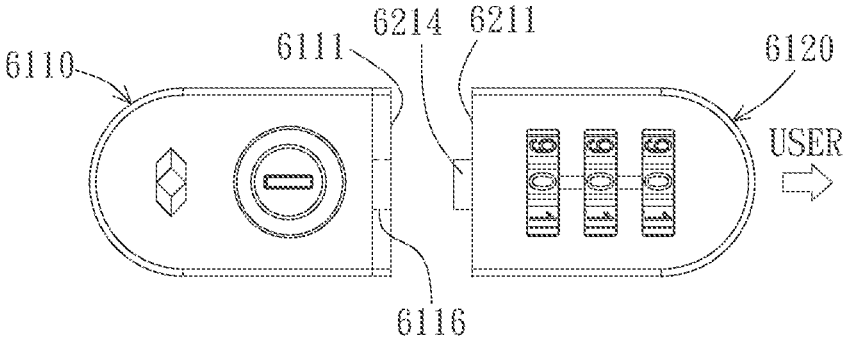
Figure 6E:
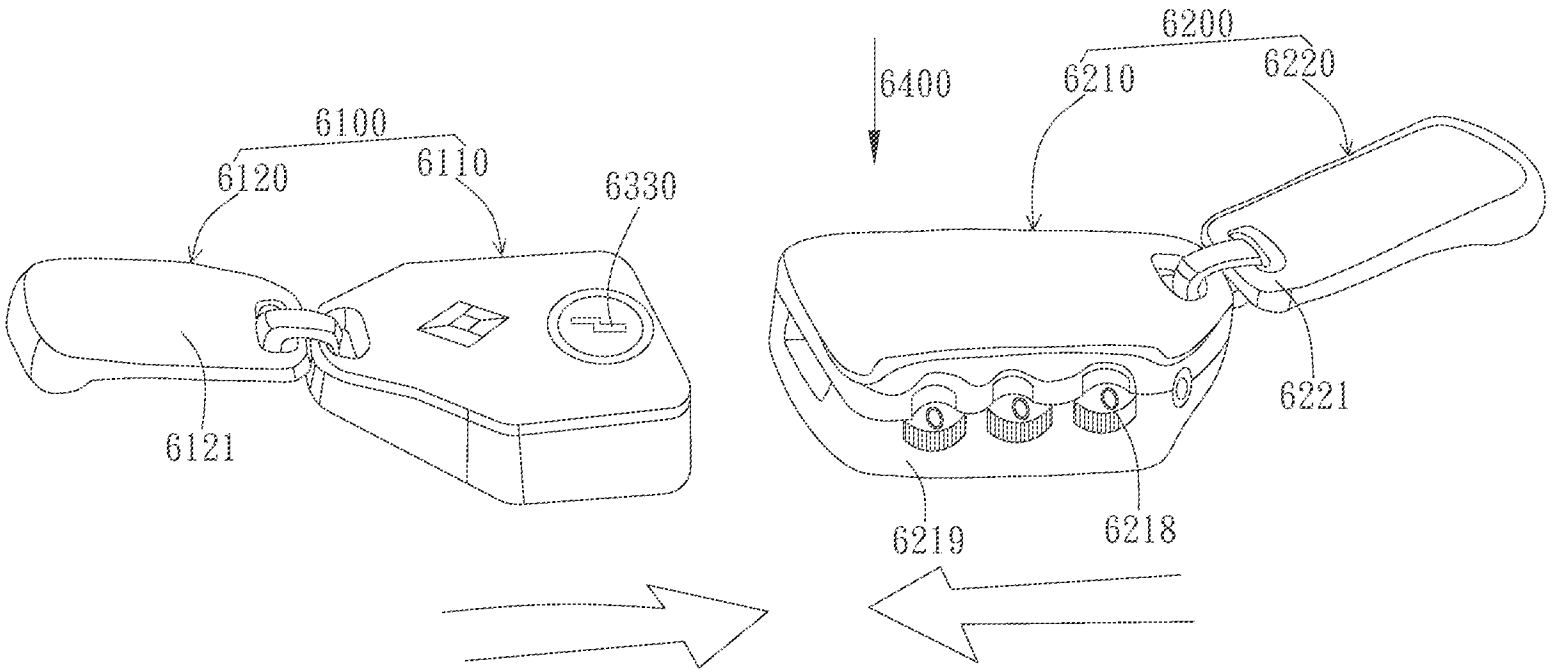

As shown in the embodiments in FIGS. 6A and 6B, the zipper slider lock of the present invention includes a first sliding device 6100 and a second sliding device 6200. The first sliding device 6100 includes a first slider lock 6110 and a first puller 6120, wherein one end 6121 of the first puller 6120 is connected to one end of the first slider lock 6110. The second sliding device 6200 includes a second slider lock 6210 and a second puller 6220, wherein one end 6221 of the second puller 6220 is connected to one end of the second slider lock 6210. When the first slider lock 5110 and the second slider lock 5210 are in adjacent positions, the first slider lock 5110 and the second slider lock 5210 cling to each other and can be locked. More particularly, as shown in the embodiment in FIG. 6C, a first pin part 6114 is disposed on an end face 6111 of the first slider lock 6110, wherein a second lock hole 6216 corresponding to the first pin part 6114 is disposed on an end face 6211 of the second slider lock 6210. When the first slider lock 5110 and the second slider lock 5210 cling to each other, the first pin part 6114 is inserted into the second lock hole 6216 and can be locked by the second slider lock 6210. As shown in the other embodiment in FIG. 6D, a second pin part 6214 is disposed on the end face 6211 of the second slider lock 6210, wherein a first lock hole 6116 corresponding to the second pin part 6214 is disposed on an end face 6111 of the first slider lock 6110. When the first slider lock 5110 and the second slider lock 5210 cling to each other, the second pin part 6214 is inserted into the first lock hole 6116 and can be locked by the first slider lock 6110. On the other hand, as shown in the embodiment in FIG. 6E, the second slider lock 6210 is a combination lock. The number discs 6218 are disposed on the side 6219 of the second slider lock 6210. In a preferable embodiment, the first slider lock 6110 includes a customs lock core and a third lock hole 6330. The authorities such as the customs can insert keys provided by the manufacturer of the lock into the third lock hole 6330 to unlock the lock.

Figure 7A:
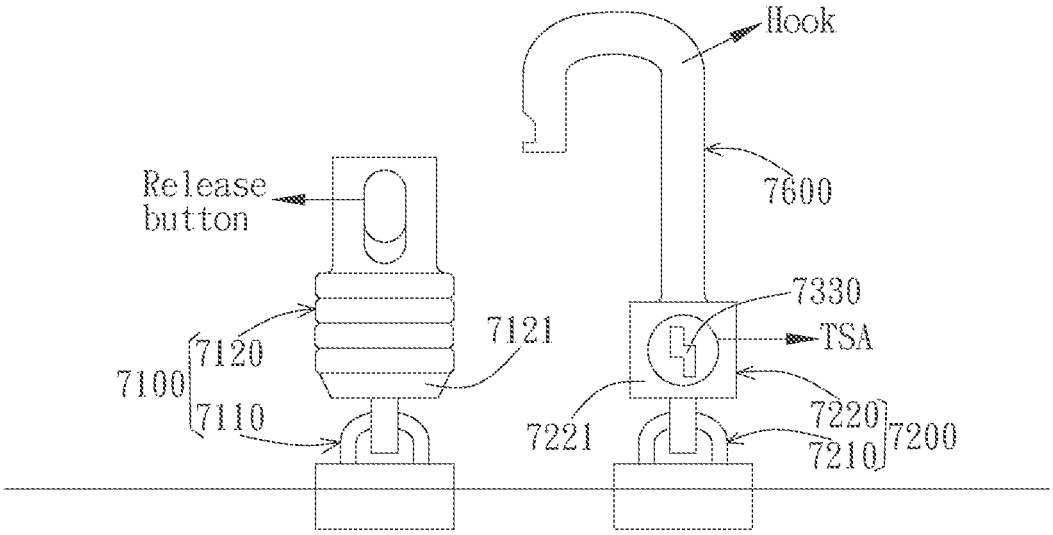
FIGS. 7A-7D are schematic views of another embodiment of the present invention.
Figure 7B:
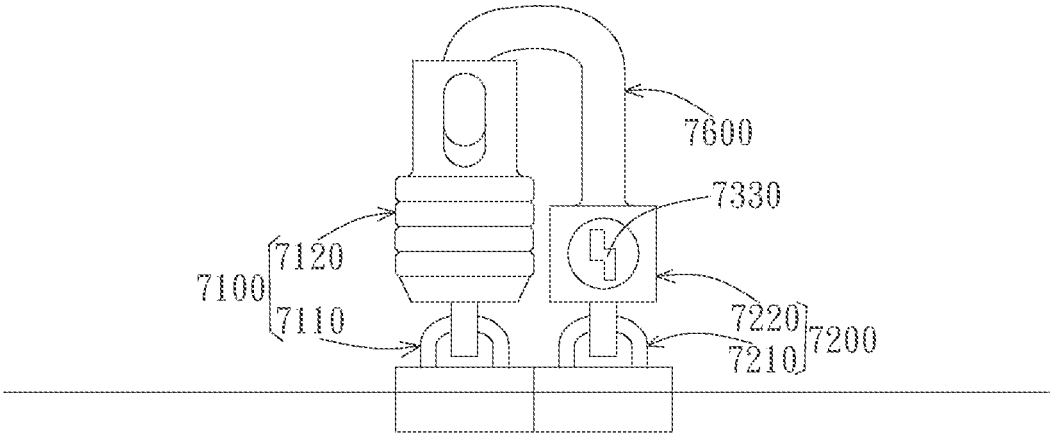
Figure 7C:
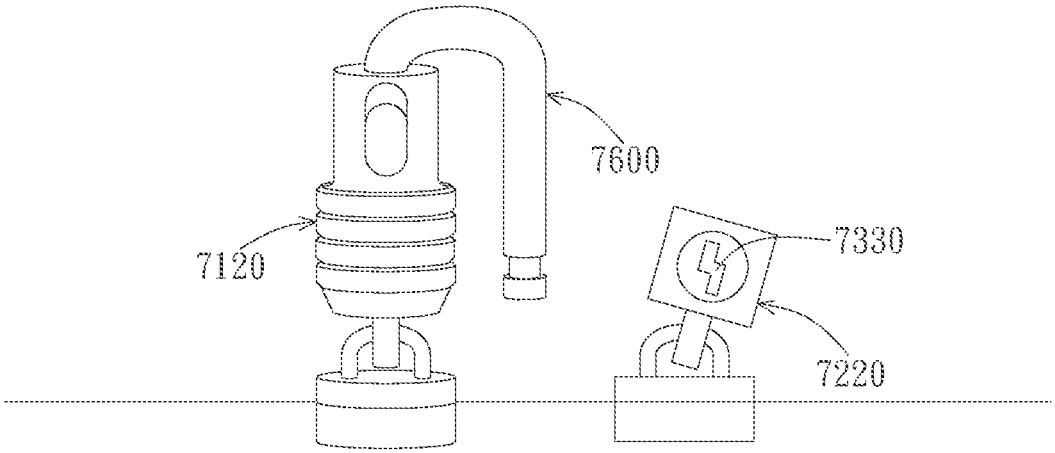
Figure 7D:
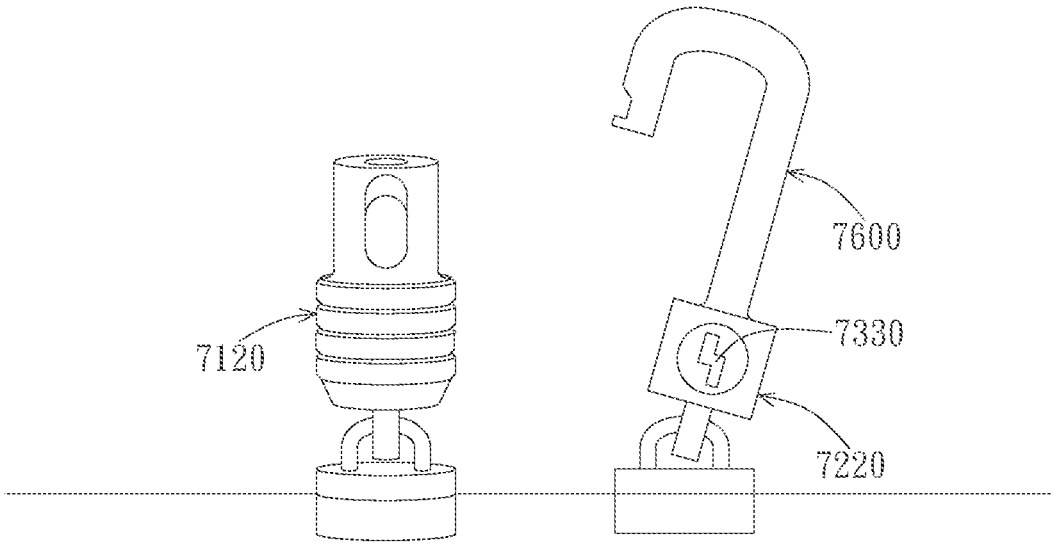

As shown in the embodiment in FIG. 7A, the zipper slider lock of the present invention includes a first sliding device 7100, a fastening unit 7600, and a second sliding device 7200. The first sliding device 7100 includes a first slider 7110 and a first puller lock 7120, wherein one end 7121 of the first puller lock 7120 is connected to one end of the first slider 7110. The second sliding device 7200 includes a second slider 7210 and a second puller lock 7220, wherein one end 7221 of the second puller lock 7220 is connected to one end of the second slider 7210. As shown in FIG. 7B, when the first slider 7110 and the second slider 7210 are in adjacent positions, the first puller lock 7120 and the second puller lock 7220 cling to each other, wherein the opposite ends of the fastening unit 6000 are inserted into and are locked by the first puller lock 7120 and the second puller lock 7220 respectively. Specifically, as shown in FIGS. 7C and 7D, the fastening unit 6000 can be locked by either the first puller lock 7120 or the second puller lock 7220, wherein in either case the first slider 7110 and the second slider 720 are able to leave each other. In a preferable embodiment, the second puller lock 7220 includes a customs lock core and a third lock hole 7330. The authorities such as the customs can insert keys provided by the manufacturer of the lock into the third lock hole 7330 to unlock the lock.

Figure 8:
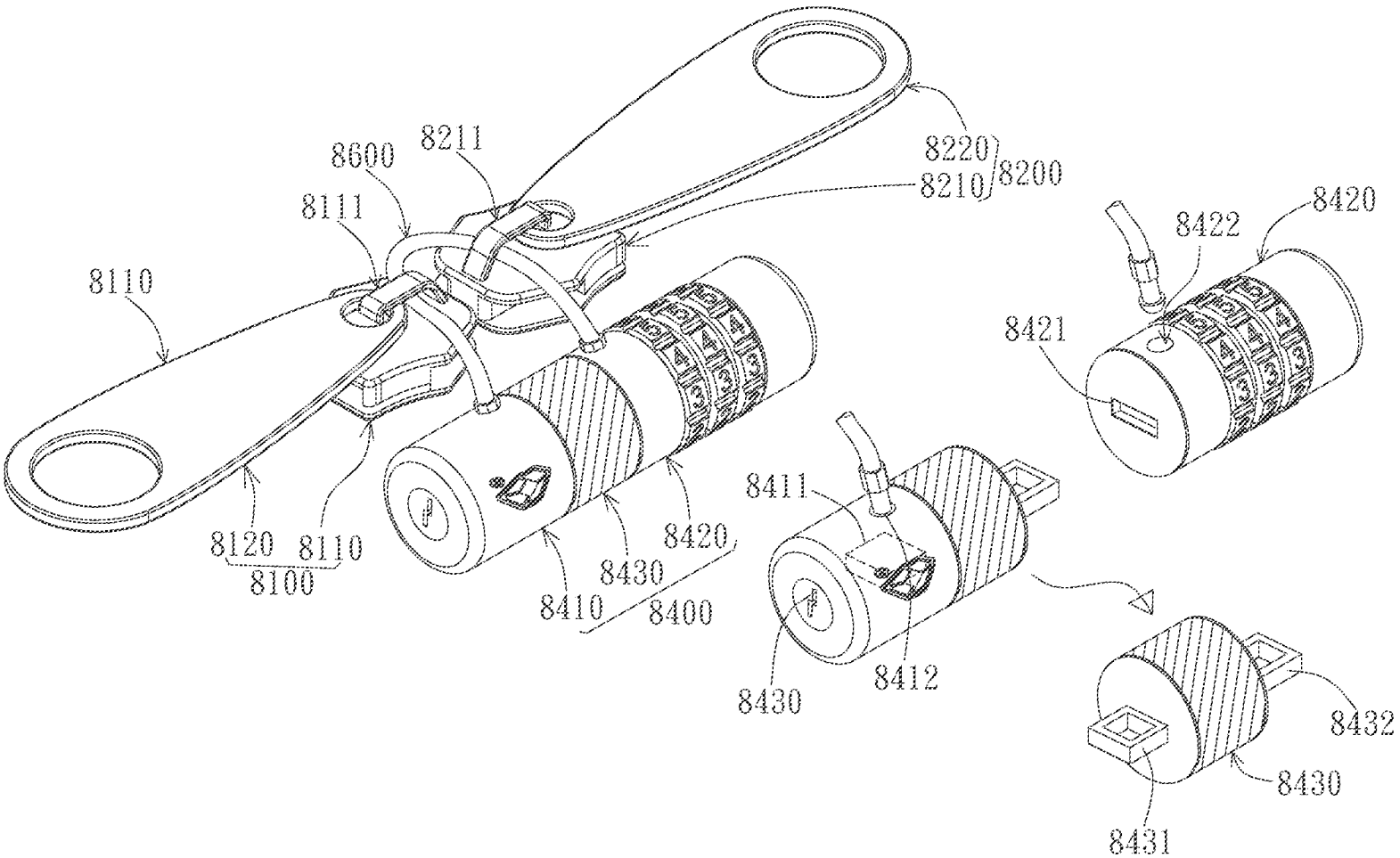
FIG. 8 is schematic view of another embodiment of the present invention.

As shown in the embodiment in FIG. 8, the zipper slider lock of the present invention is used with a first sliding device 8100 and a second sliding device 8200. The zipper slider lock includes a lock device 8400 and a cable 8600. The first sliding device 8100 includes a first slider 8110 and a first puller 8120. The second sliding device 8200 includes a second slider 8210 and a second puller 8220. The first slider 8110 includes a first fixing ring 8111, wherein the first puller 8120 is connected to the first fixing ring 8111. The second slider 8210 includes a second fixing ring 8211, wherein the second puller 8220 is connected to the second fixing ring 8211. The lock device 8400 includes a first lock 8410, a second lock 8420, and a fastening unit 8430. The first lock 8410 includes a first A lock hole 8411 and a first B lock hole 8412. The second lock 8420 includes a second A lock hole 8421 and a second B lock hole 8422. The fastening unit 8430 includes a first fastening part 8431 and a second fastening part 8432 disposed at opposite ends of the fastening unit 8430. The first lock 8410, the second lock 8420, and the fastening unit 8430 are able to cling to each other to make the first fastening part 8431 and the second fastening part 8432 inserted into the first A lock hole 8411 and the second A lock hole 8421 respectively and be locked by the first lock 8410 and the second lock 8420 respectively.

When the first slider 8110 and the second slider 8210 are in adjacent positions, one end of the cable 8600 can pass through the first B lock hole 8412 and be locked by the first lock 8410, wherein the other end of the cable 8600 can pass through the first fixing ring 8111 and the second fixing ring 8211 as well as the second B lock hole 8422 and be locked by the second lock 8420. Accordingly, the cable 8600 restricts the first slider 8110 and the second slider 8210 from leaving each other. In a preferable embodiment, the first lock 8410 includes a customs lock core and a third lock hole 7430. The authorities such as the customs can insert keys provided by the manufacturer of the lock into the third lock hole 8430 to unlock the lock.

Figure 9A:
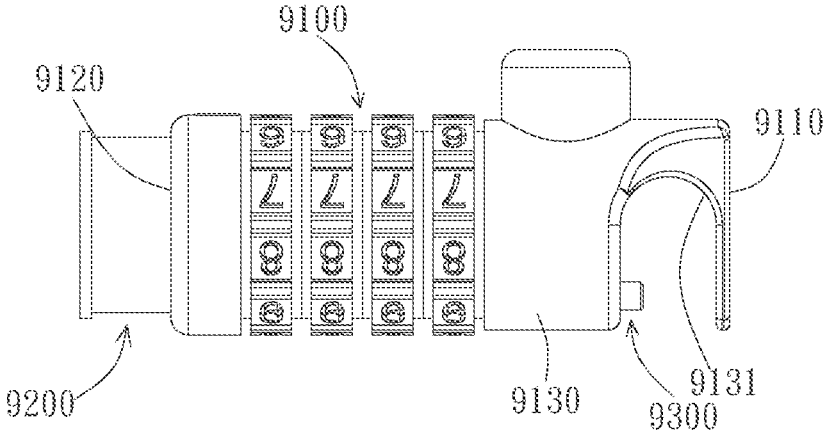
FIGS. 9A-9G are schematic views of another embodiment of the present invention.
Figure 9B:
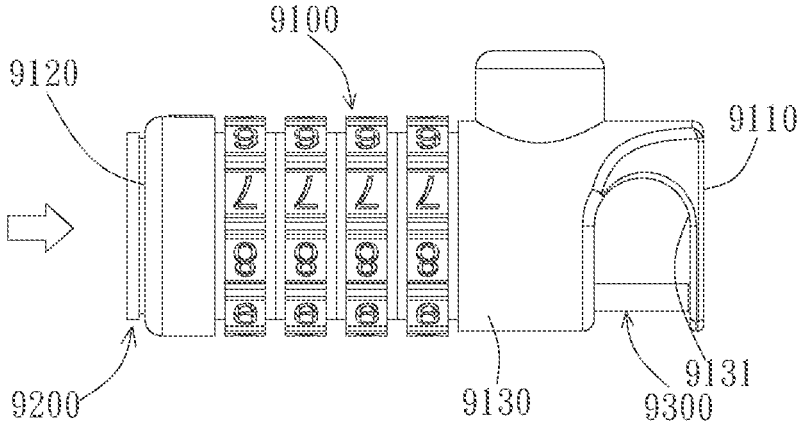
Figure 9C:
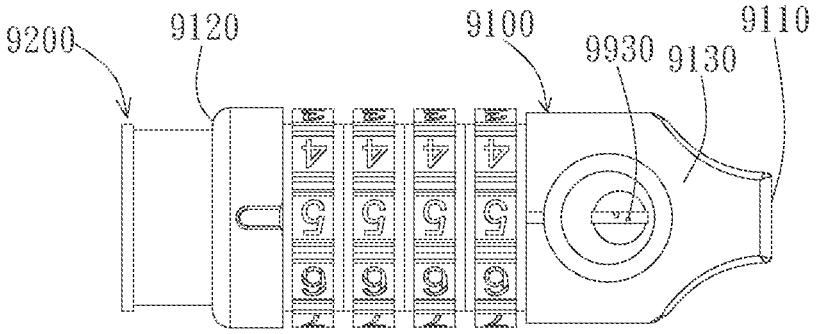
Figure 9D:
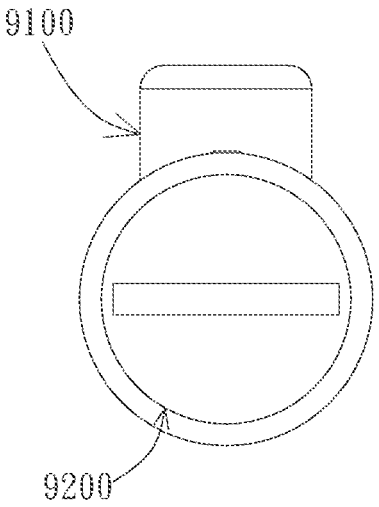
Figure 9E:
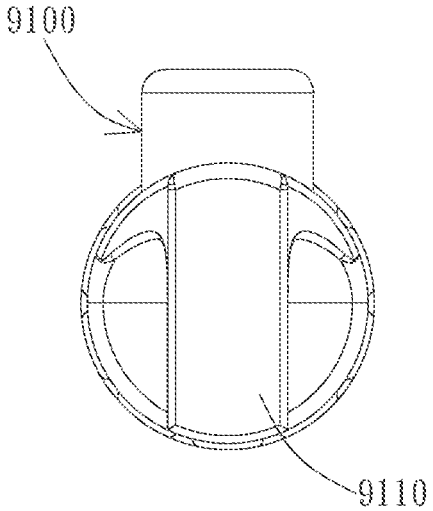
Figure 9F:
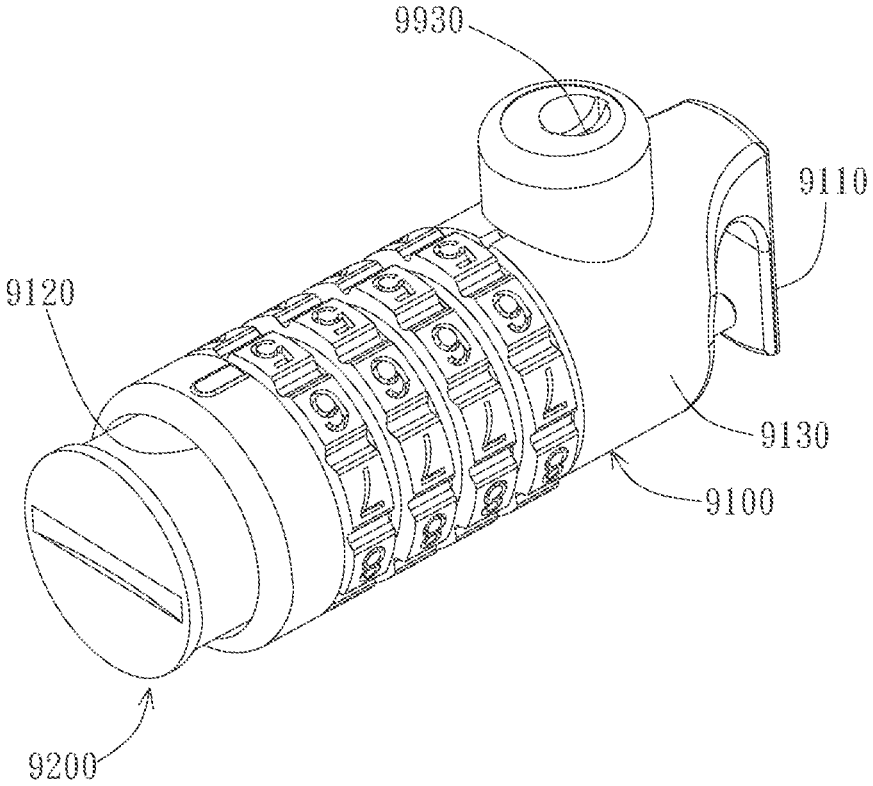

As shown in the embodiment in FIG. 9A, the zipper slider lock of the present invention includes a lock body 9100, a button 9200, and a bolt 9300. The lock body 9100 includes a first end face 9110, a second end face 9120, and a cylinder surface 9130. One end of the lock body 9100 close to the first end face 9110 invaginates from the cylinder surface 9130 to form a first recess 9131. The button 9200 is disposed on the second end face 9120 and can be pressed into the lock body 9100 by an external force. The bolt 9300 is disposed in the lock body 9100 and moves together with the button 9200. When the button 9200 is pressed into the lock body 9100 by the external force, the bolt 9300 extends out of the lock body 9300 and toward the first recess 9131 to close the first recess 9131, as shown in FIG. 9E. FIGS. 9C-9F are schematic views of the zipper slider lock with different views.

Figure 9G:
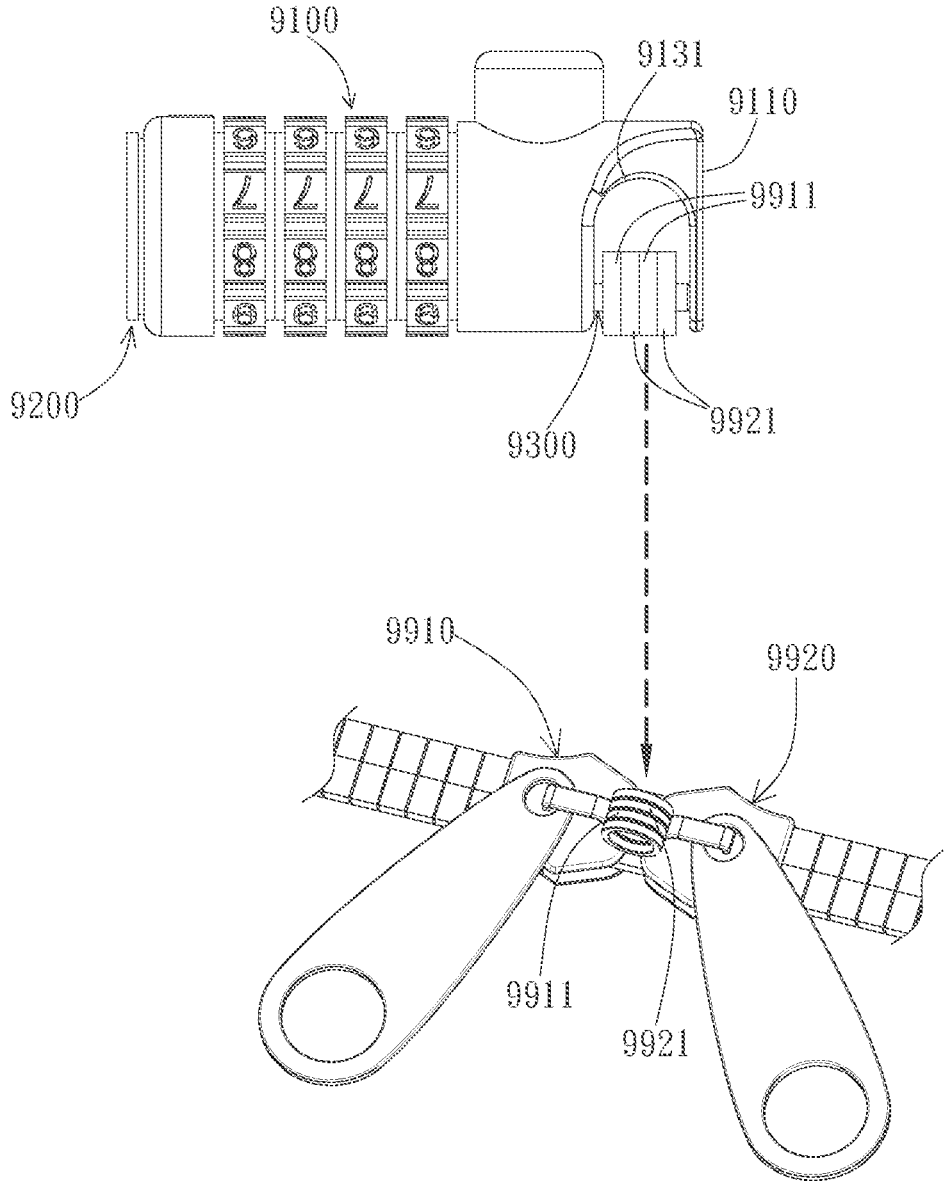

More particularly, as shown in FIG. 9G, the first slider 9910 has a first fixing ring 9911, wherein the second slider 9920 has a second fixing ring 9921. When the first slider 9910 and the second slider 9920 are in adjacent positions, the first fixing ring 9911 and the second fixing ring 9921 overlap to make their holes aligned to form a passage. One can move the zipper slider lock to have the first fixing ring 9911 and the second fixing ring 9921 in the first recess 9131, press the button 9200 into the lock body 9100 to make the bolt 9300 extend out of the lock body 9300 and toward the first recess 9131 to pass through the first fixing ring 9911 and the second fixing ring 9921, and lock the bolt 9300 by the lock body 9100. Accordingly, the bolt 9300 is able to restrict the first slider 9910 and the second slider 9920 from leaving each other. In a preferable embodiment, the lock body 9100 includes a customs lock core and a third lock hole 9930 (see FIG. 9F). The authorities such as the customs can insert keys provided by the manufacturer of the lock into the third lock hole 9930 to unlock the lock.

Figure 10A:
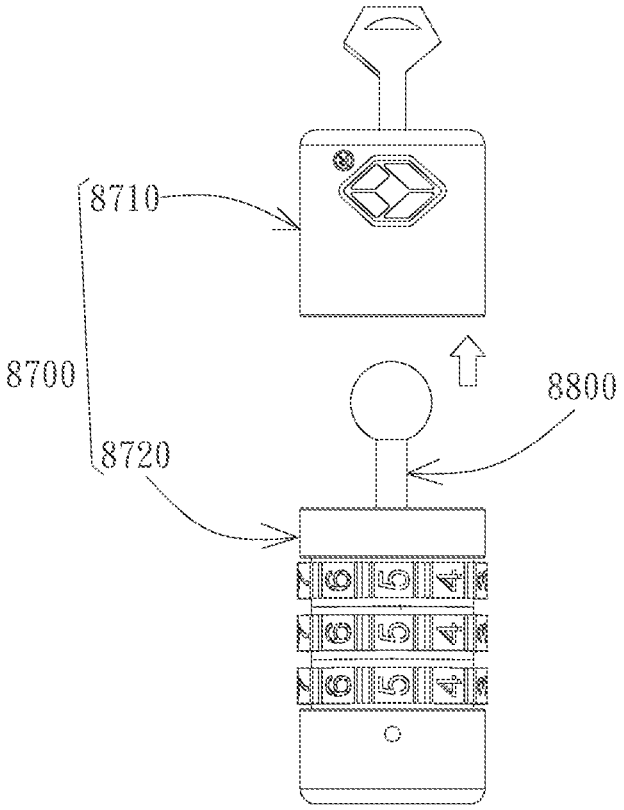
FIGS. 10A-10E are schematic views of another embodiment of the present invention.
Figure 10B:
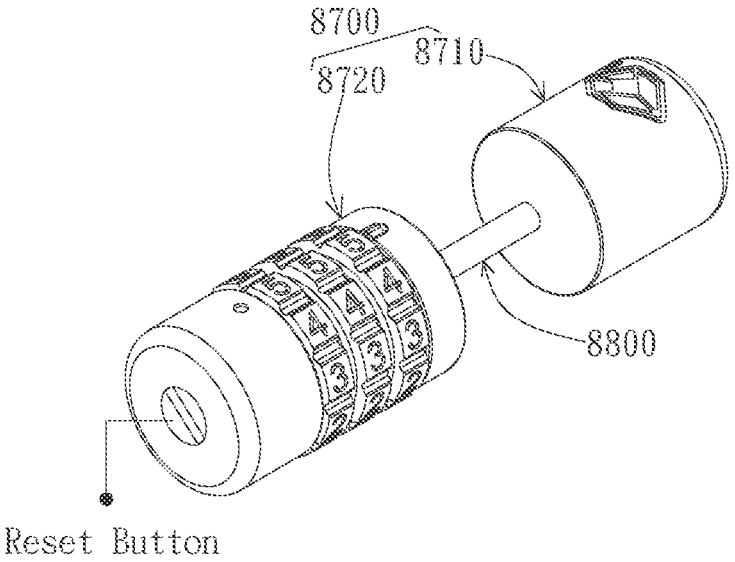
Figure 10C:
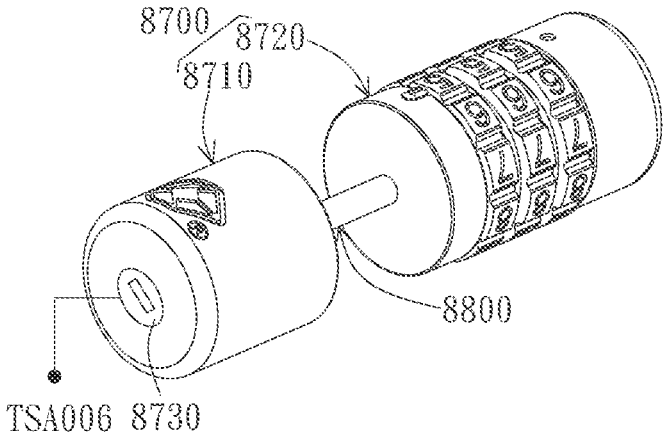
Figure 10D:
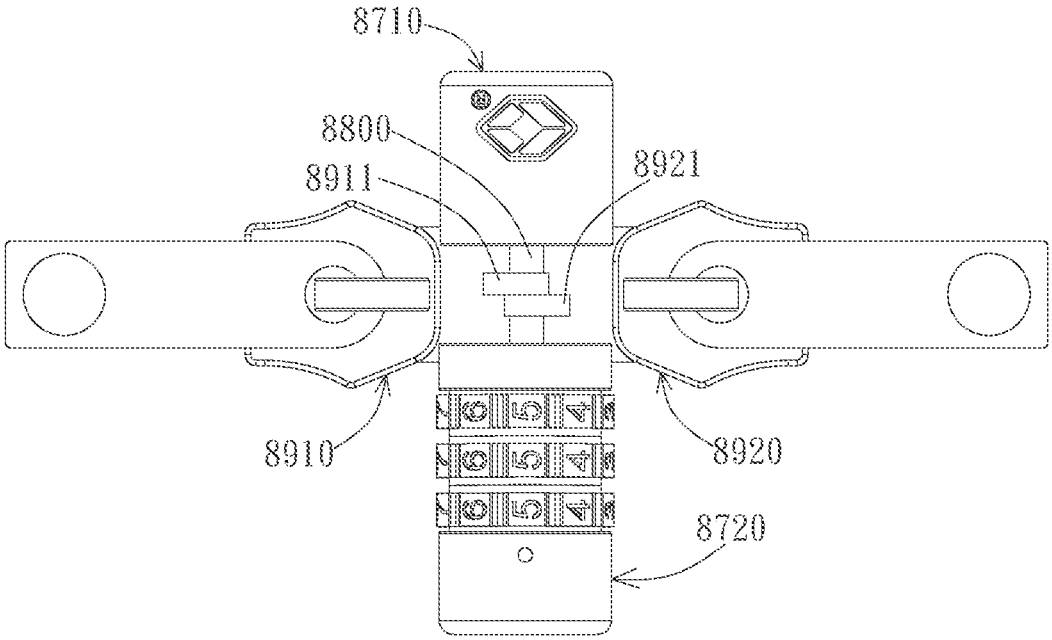
Figure 10E:
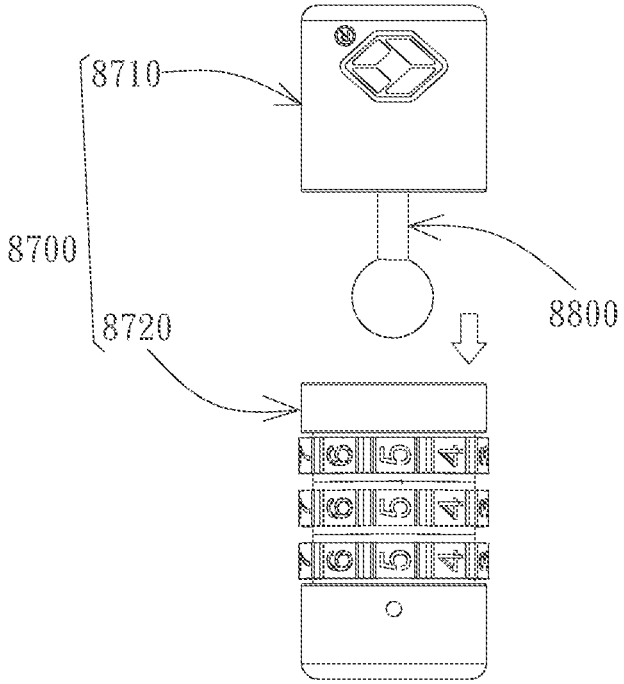

As shown in the embodiments in FIGS. 10A-10E, the zipper slider lock of the present invention includes a lock device 8700 and a rod 8800. The lock device 8700 includes a first lock 8710 and a second lock 8720. The opposite ends of the rod 880 can be inserted into and be locked by the first lock 8710 and the second lock 8720 respectively. As shown in FIG. 10D, the zipper slider lock of the present invention is used with a first sliding device 8910 and a second sliding device 8920. The first slider 8910 has a first fixing ring 8911, wherein the second slider 8920 has a second fixing ring 8921. When the first slider 8910 and the second slider 8920 are in adjacent positions, the first fixing ring 8911 and the second fixing ring 8921 overlap to make their holes aligned to form a passage. One can make the rod 8800 pass through the first fixing ring 8911 and the second fixing ring 8921, insert the opposite ends of the rod 8800 into the first lock 8710 and the second lock 8720 respectively, and lock the opposite ends of the rod 8800 by the first lock 8710 and the second lock 8720 respectively. Accordingly, the rod 8800 is able to restrict the first slider 8910 and the second slider 8920 from leaving each other. In a preferable embodiment, the first lock 8710 includes a customs lock core and a third lock hole 8730 (see FIG. 10C). The authorities such as the customs can insert keys provided by the manufacturer of the lock into the third lock hole 8730 to unlock the lock.

Figure 11A:
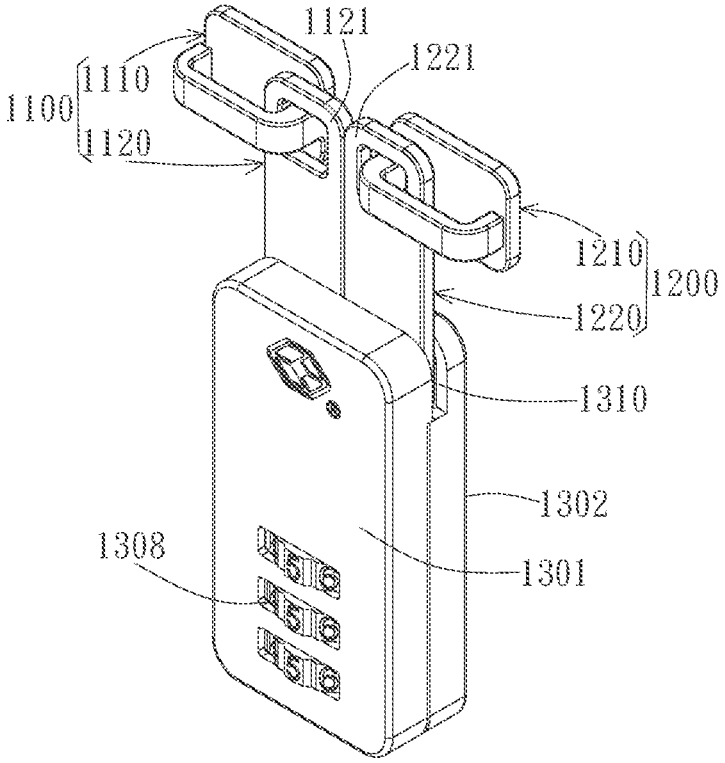
Figure 11B:
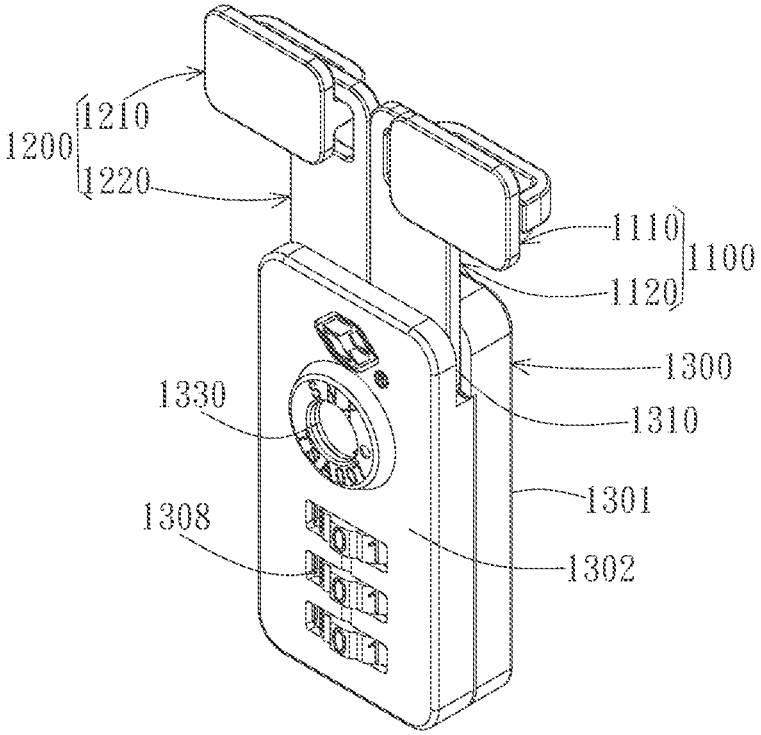
Figure 11C:
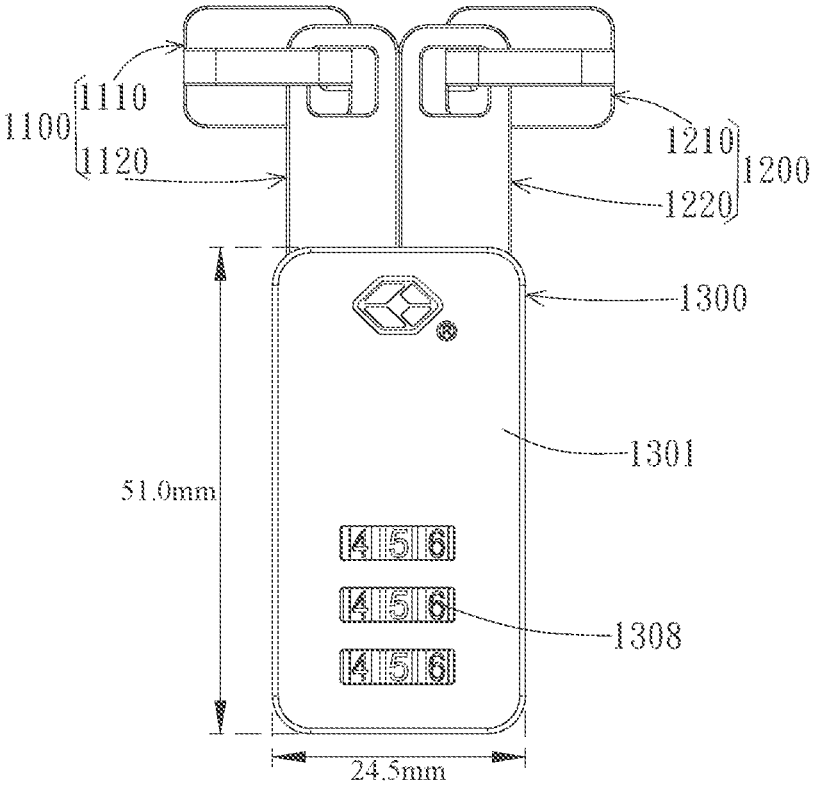
Figure 11D:
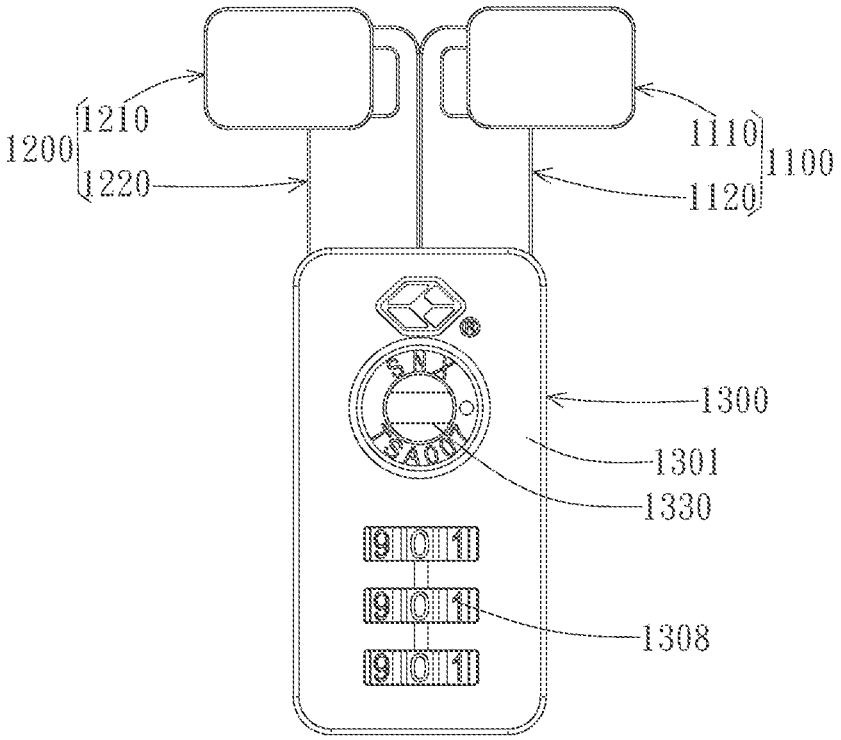
Figure 11E:
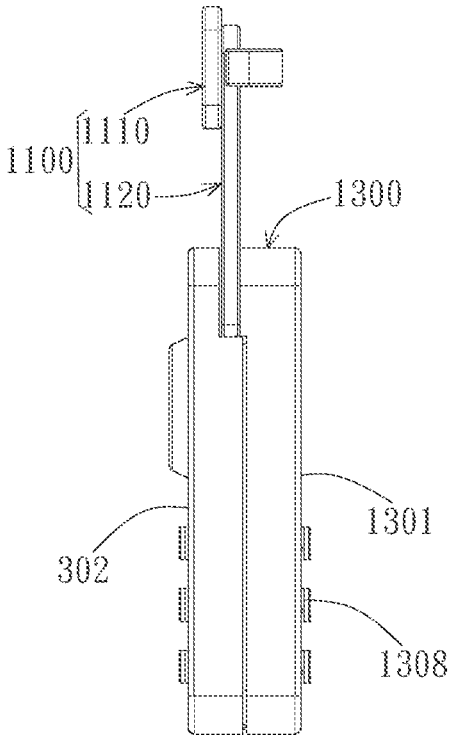
Figure 11F:
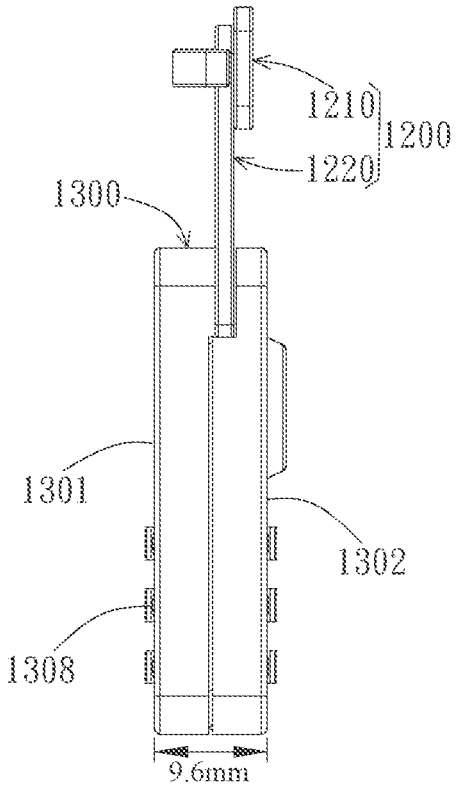
Figure 11G:
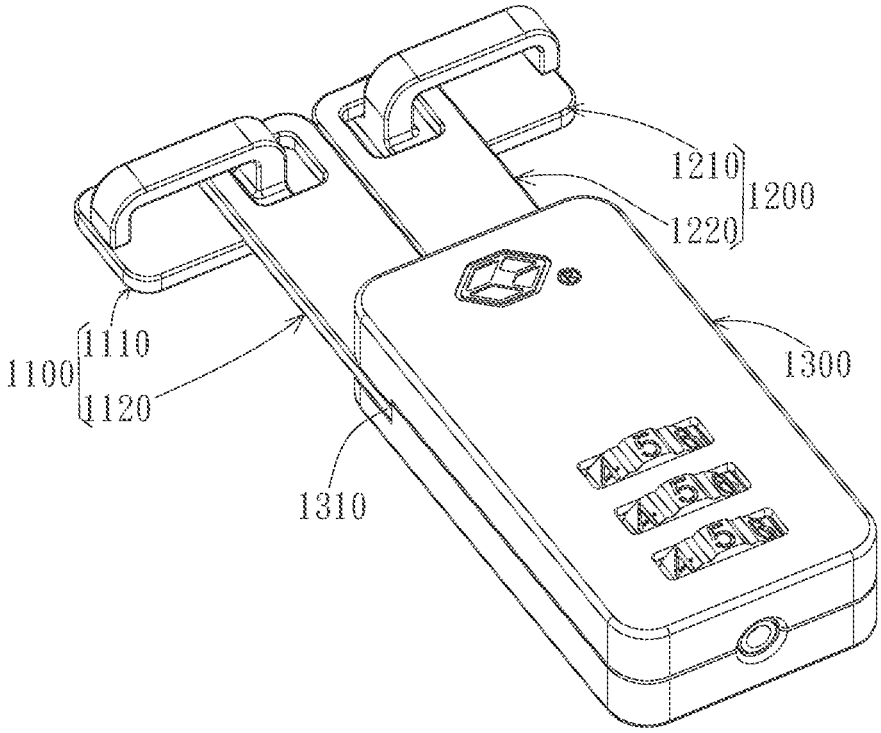

As shown in the embodiment in FIGS. 11A and 11B, the zipper slider lock of the present invention includes a first sliding device 1100, a second sliding device 1200, and a lock body 1300. The first sliding device 1100 includes a first slider 1110 and a first puller 1120, wherein one end 1121 of the first puller 1120 is connected to the first slider 1110. The second sliding device 1200 includes a second slider 1210 and a second puller 1220, wherein one end 1221 of the second puller 1220 is connected to the second slider 1210. When the first slider 1110 and the second slider 1210 are in adjacent positions, one side of the first puller 1120 and one side of the second puller 1220 cling to each other.

As shown in FIGS. 11A and 11B, one end of the lock body 1300 includes a first lock hole 1310. When the first slider 1110 and the second slider 1210 are in adjacent positions, the first puller 2120 and the second puller 2220 can be inserted into the first lock hole 2310in order to be locked by the lock body 1300, hence the sliding device 1100 and the second sliding device 1200 are restricted from leaving each other. In an embodiment, the lock body is a combination lock, wherein both a first side face 1301 and a second side face 1302 of the lock body 1300 expose the number discs 1038. The second side face 1302 further includes a a third lock hole 1330. The authorities such as the customs can insert keys provided by the manufacturer of the lock body into the third lock hole 1330 to unlock the lock. FIGS. 11C-11G are schematic views of the zipper slider lock with different views.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A zipper slider lock, comprising:

a first sliding device including a first slider lock and a first puller, wherein one end of the first slider lock has a first slider lock hole, wherein the other end of the first slider lock connects to the first puller;

a second sliding device including a second slider lock and a second puller, wherein one end of the second slider lock has a second slider lock hole, wherein the other end of the second slider lock connects to the second puller, wherein the first slider lock and the second slider lock are respectively key lock and combination lock; and a fastening unit including a first fastening part and a second fastening part disposed at opposite ends of the fastening unit;

when the first slider lock and the second slider lock are in adjacent positions, the first slider lock, the fastening unit, and the second slider lock cling to each other, wherein the fastening unit is between the first slider lock and the second slider lock;

wherein the first fastening part and the second fastening part are inserted into the first slider lock hole and the second slider lock hole respectively and can be locked by the first slider lock and the second slider lock respectively.

2. A zipper slider lock, comprising:

a first sliding device including a first slider lock and a first puller, wherein one end of the first puller is connected to one end of the first slider lock;

a second sliding device including a second slider lock and a second puller, wherein one end of the second puller is connected to one end of the second slider lock, wherein the first slider lock and the second slider lock are respectively key lock and combination lock;

when the first slider lock and the second slider lock are in adjacent positions, the first slider lock and the second slider lock cling to each other and can be locked.

3. The zipper slider lock of claim 2, wherein:

a first pin part is disposed on an end face of the first slider lock, wherein a second lock hole corresponding to the first pin part is disposed on an end face of the second slider lock;

when the first slider lock and the second slider lock cling to each other, the first pin part is inserted into the second lock hole and can be locked by the second slider lock.

* * * * *